US007470649B2

(12) United States Patent
Nakane et al.

(10) Patent No.: US 7,470,649 B2
(45) Date of Patent: Dec. 30, 2008

(54) THERMAL TRANSFER IMAGE RECEIVING SHEET

(75) Inventors: Hiroki Nakane, Hino (JP); Tadanobu Sekiya, Hachioji (JP)

(73) Assignee: Konica Minolta Photo Imaging, Inc., Tokyo (JP)

( * ) Notice: Subject to any disclaimer, the term of this patent is extended or adjusted under 35 U.S.C. 154(b) by 353 days.

(21) Appl. No.: 11/117,627

(22) Filed: Apr. 28, 2005

(65) Prior Publication Data

US 2005/0255259 A1 Nov. 17, 2005

(30) Foreign Application Priority Data

May 11, 2004 (JP) ..... 2004-140925

(51) Int. Cl.
*B41M 5/50* (2006.01)

(52) U.S. Cl. ..... 503/227; 427/152; 428/32.5

(58) Field of Classification Search ..... None
See application file for complete search history.

(56) References Cited

U.S. PATENT DOCUMENTS 5,378,675 A * 1/1995 Takeyama et al. ..... 503/227
6,013,602 A * 1/2000 Kamikubo et al. ..... 503/227
7,041,349 B2 * 5/2006 Tanaka et al. ..... 428/32.63

FOREIGN PATENT DOCUMENTS

JP 11-301124 * 11/1999
JP 2000-158831 * 6/2000

* cited by examiner

*Primary Examiner*—Bruce H Hess
(74) *Attorney, Agent, or Firm*—Lucas & Mercanti, LLP

(57) ABSTRACT

A thermal transfer image receiving sheet containing a substrate having thereon a porous intermediate layer and an image receiving layer in that order, wherein the porous intermediate layer has a void ratio of not less than 30%; the porous intermediate layer contains inorganic microparticles; and the porous intermediate layer and the image receiving layer are formed by a coating method.

26 Claims, 1 Drawing Sheet

THERMAL TRANSFER IMAGE RECEIVING SHEET

This application is based on Japanese Patent Application No. 2004-140925 filed on May 11, 2004, in Japanese Patent Office, the entire content of which is hereby incorporated by reference.

FIELD OF THE INVENTION

The present invention relates to a thermal transfer image receiving sheet having a porous intermediate layer, which is used by overlapping with a thermal transfer ink sheet.

BACKGROUND

A technique, so called as a dye thermal transfer method, is known, in which an ink sheet containing a thermal diffusive colorant capable of thermally transferring by diffusion is faced to an image receiving layer of an image receiving sheet and the thermal diffusive colorant is imagewise transferred to the image receiving layer by a thermal printing means such as a thermal head or a laser to form an image. The thermal transfer method has been acknowledged as a method which enables forming an image using digital data without using any treatment liquid such as a developer, and forming an image having high quality comparable to that of a silver salt photograph.

It has been recognized that it is important to give a heat insulation function and a cushion function to the thermal image receiving sheet for obtaining a high quality image forming property in the recording system using the dye thermal transfer method.

For such problems, known is a method in which a foamed film having a function of heat insulation and a function of cushion is pasted on a substrate and an image receiving layer is provided on the foamed film. In this method, however, the foamed film shrinks by heat generated when the image receiving layer is applied on the foamed film, resulting in curling of the produced sheet. In order to overcome the problem, various methods have been tested, for example: (i) using a novel functional layer having a heat insulating function and a cushioning function; (ii) using a thermal transfer image receiving sheet produced by a process including no pasting step of the foamed film to minimize the curl caused by the heat generated in the production process; and (iii) using a variety of coating method.

For example, a thermal transfer image receiving sheet is disclosed, in which a resin containing aqueous liquid is foamed by mechanical stirring and coated to form a porous resin layer so that the apparent density of the porous layer is controlled to 0.05 to 0.5 g/cm$^3$ (for example, Patent Document 1). However, in the above proposed method, it is not fully easy to stably obtain a desired foaming ratio of the coating liquid in the coating step of the industrial production process. Further, the coagulation of foam may not be controlled by the disclosed method, resulting in causing uneven image quality due to white spots in the image or lowering in the sensitivity.

Furthermore, a thermal transfer image receiving sheet is disclosed, in which the viscosity of a coating liquid containing a foamed particle having the heat insulation and the cushion functions is controlled into a certain range and an intermediate layer is formed by coating the foregoing coating liquid (for example, Patent Documents 2 and 3). In the art disclosed in the Patent Documents, however, lowering in the mechanical strength of the foamed particle-containing layer is caused by the constituting materials containing the foam and by the production process thereof. As a result, sticking tends to occur when the thermal transfer image receiving sheet is separated from the thermal transfer ink sheet.

In order to overcome the problem, a multi-layered thermal transfer image receiving sheet having a separation layer on the image receiving layer has been proposed, however, a quality sufficiently acceptable for the recent high speed printing has not been fully attained, and further improvement is demanded.

Patent Document 1: Japanese Patent Publication Open to Public Inspection (hereafter referred to as JP-A) No. 11-301124, Patent Document 2: JP-A No. 2000-158831

Patent Document 3: JP-A No. 2000-238440

SUMMARY OF THE INVENTION

An object of the invention is to provide a thermal transfer image receiving sheet exhibiting minimized curling caused in the production process, sufficient printing sensitivity, an excellent image without white spots in the image and anti-sticking property even in a high speed printer.

One of the aspects of the invention is a thermal transfer image receiving sheet containing a substrate having thereon a porous intermediate layer and an image receiving layer in that order, wherein the porous intermediate layer has a porosity of not less than 30%; the porous intermediate layer contains inorganic microparticles; and the porous intermediate layer and the image receiving layer are formed by a coating method.

DESCRIPTION OF THE PREFERRED EMBODIMENTS

Figure 1:
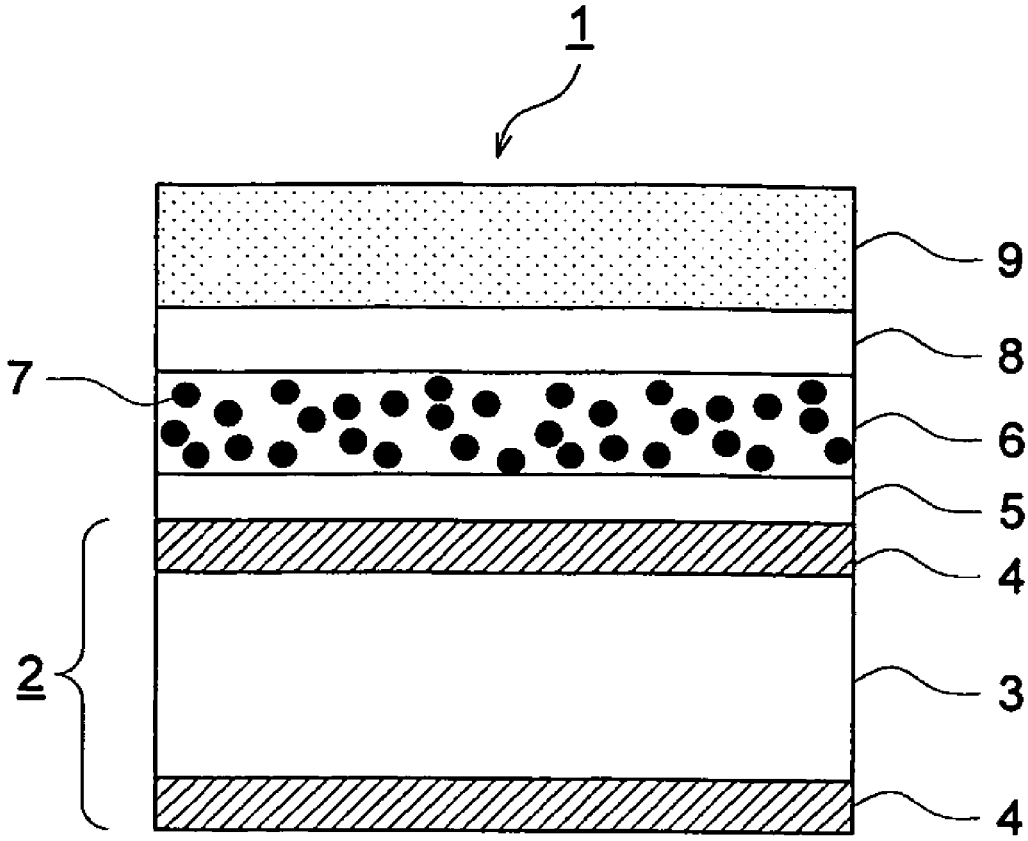
FIG. 1 is a schematic drawing of a typical example of the constitution of the thermal transfer image receiving sheet.

The object of the invention is achieved by the following structures.

(1) A thermal transfer image receiving sheet containing a substrate having thereon a porous intermediate layer and an image receiving layer in that order, wherein the porous intermediate layer has a void ratio of not less than 30%;

the porous intermediate layer contains inorganic microparticle; and the porous intermediate layer and the image receiving layer are formed by a coating method.

(2) The thermal transfer image receiving sheet of Item (1), wherein the inorganic microparticles contained in the porous intermediate layer are selected from the group consisting of silica, alumina and titania.

(3) The thermal transfer image receiving sheet of Item (1) or Item (2), wherein the porous intermediate layer contains:

a hydrophilic binder; or an emulsion resin binder formed by emulsion polymerization using a polymer dispersant containing a hydroxyl group.

(4) The thermal transfer image receiving sheet of any one of Items (1) to (3), wherein a coating solution for a layer applied on the porous intermediate layer has a viscosity of not less than 30 mPa·s.

(5) The thermal transfer image receiving sheet of any one of Items (1) to (4), wherein a solid content of the porous intermediate layer is not more than 80% by weight when another layer is applied on the porous intermediate layer.

(6) The thermal transfer image receiving sheet of any one of Items (1) to (5), wherein the image receiving layer contains a compound having a metal ion; and the compound having the metal ion forms a chelate compound by reacting with a colorant capable of forming a chelate.

(7) The thermal transfer image receiving sheet of Item (6), wherein the compound having a metal ion is an inorganic salt.

(8) The thermal transfer image receiving sheet of any one of Items (1) to (7), wherein the substrate is a resin coated paper sheet having a thickness of 50 to 250 μm.

(9) The thermal transfer image receiving sheet of any one of Items (1) to (8), wherein a second intermediate layer is provided between the porous intermediate layer and the image receiving layer.

(10) The thermal transfer image receiving sheet of Item (9), wherein the second intermediate layer contains microparticles.

(11) The thermal transfer image receiving sheet of any one of Items (1) to (10), wherein the image receiving layer contains a resin selected from the group consisting of a polycarbonate resin, a cellulose resin and a polyester resin.

(12) The thermal transfer image receiving sheet of any one of Items (1) to (11), wherein a coating solution for the image receiving layer has a pH of not more than 8.0.

(13) The thermal transfer image receiving sheet of any one of Items (1) to (12), wherein the intermediated layer or the image receiving layer contains a hardening agent.

(14) The thermal transfer image receiving sheet of any one of Items (1) to (12), wherein the image receiving layer contains a release agent.

(15) The thermal transfer image receiving sheet of Item (14), wherein the release agent is a silicone emulsion release agent or a water-soluble release agent.

(16) The thermal transfer image receiving sheet of any one of Items (1) to (12), wherein the image receiving layer contains a silicone surfactant.

(17) The thermal transfer image receiving sheet of any one of Items (1) to (12), wherein the image receiving layer contains a fluorinated surfactant.

(18) The thermal transfer image receiving sheet of any one of Items (1) to (12), wherein a thermal conductivity of the thermal transfer image receiving-sheet is not more than 0.35 W/mK.

(19) The thermal transfer image receiving sheet of Item (18), wherein the thermal conductivity of the thermal transfer image receiving sheet is not more than 0.27 W/mK.

According to the invention, a thermal transfer image receiving sheet exhibiting minimized curling caused in the production process, sufficient printing sensitivity, an excellent image without white spots in the image and anti-sticking property even in a high speed printer is provided.

It was found that, in a thermal transfer image receiving sheet having a porous intermediate layer and an image receiving layer on a substrate, a thermal transfer image receiving sheet exhibiting minimized curling caused in the production process, sufficient printing sensitivity, an excellent image without white spots in the image and anti-sticking property even in a high speed printer can be achieved by any one of the following constitution.

The first invention is characterized in that: (i) the porous intermediate layer has the void ratio of not less than 30%; (ii) the porous intermediate layer contains inorganic microparticles; and (iii) the porous intermediate layer is formed by a coating method. By the above constitution, the porous intermediate layer can be stably formed and a thermal transfer image receiving sheet exhibiting minimized curling caused in the production process, sufficient printing sensitivity, an excellent image without white spots in the image and anti-sticking property even in a high speed printer can be obtained.

The second invention is characterized in that: (i) the porous intermediate layer has the void ratio of not less than 30%; (ii) the porous intermediate layer contains inorganic microparticles; (iii) the porous intermediate layer is formed by a coating method; and (iv) the porous intermediate layer or the image receiving layer contains a hardening agent. By the above constitution, the porous intermediate layer can be stably formed and a thermal transfer image receiving sheet excellent in the mechanical strength-can be obtained.

The third invention is characterized in that: (i) the porous intermediate layer has the void ratio of not less than 30%; (ii) the porous intermediate layer contains inorganic microparticles; and (iii) the porous intermediate layer is formed by a coating method; and (iv) the image receiving layer contains a release agent. By the above constitution, (a) the porous intermediate layer can be stably formed; (b) the heat insulation function and the cushion function of the image receiving sheet can be sufficiently achieved; and (c) the thermal adhesion of the image receiving layer and the ink layer of the thermal transfer ink sheet in the process of image formation can be effectively prevented.

The fourth and fifth inventions are characterized in that: (i) the porous intermediate layer has the void ratio of not less than 30%; (ii) the porous intermediate layer contains inorganic microparticles; (iii) the porous intermediate layer is formed by a coating method; and (iv) the image receiving layer contains a silicone surfactant or a fluorinated surfactant. By the above constitution, the porous intermediate layer can be stably formed and the heat insulation function and the cushion function of the image receiving sheet can be sufficiently achieved, and the thermal adhesion of the image receiving layer and the ink layer of the thermal transfer ink sheet on the occasion of the image formation can be effectively prevented.

The sixth invention is characterized in that: (i) the porous intermediate layer has the void ratio of not less than 30%; (ii) the porous intermediate layer contains inorganic microparticles; (iii) the porous intermediate layer is formed by a coating method; and (iv) the thermal conductivity of the thermal transfer image receiving sheet is not more than 0.35 W/mK. By the above constitution, the porous intermediate layer can be stably formed and the heat insulation function and the cushion function of the image receiving sheet can be sufficiently displayed.

The details of the invention will now be described.

<<Thermal Transfer Image Receiving Sheet>>

The thermal transfer image receiving sheet according to the invention is described in detail below.

The thermal transfer image receiving sheet of the invention has at least a porous intermediate layer and a image receiving layer on a substrate.

(Substrate)

The substrate to be employed in the thermal transfer image receiving sheet has a role of holding the image receiving layer and preferably has mechanical strength sufficient for handling even under an excessively heated condition, since heat is applied in the thermal transfer process.

Examples of the material for such a substrate include: cellulose fiber paper, for example, condenser paper, glassine paper., sulfate paper, paper having highly sized degree, synthesized paper (polyolefin type and polystyrene type), high quality paper, art paper, coated paper, cast coated paper, wall paper, backing paper, paper impregnated with synthesized resin or emulsion, synthesized rubber latex impregnated paper, synthesized resin added paper, and board paper; and films of polymer, for example, polyester, polyacrylate, polycarbonate, polyurethane, polyimide, polyetherimide, a cellulose derivative, polyethylene, ethylene-vinyl acetate copolymer, polypropylene, polystyrene, acryl, polyvinyl chloride, polyvinylidene chloride, polyvinyl alcohol, polyvinyl butyral, nylon, polyether ether ketone, polysulfone, polyether sulfone, tetrafluoroethylene, perfluoroalkylvinyl vinyl ether, polyvinyl fluoride, tetrafluoroethylen.ethylene, tetrafluoroethylene.hexafluoropropylene, polychlorotrifluoroethylene and polyvinylidene fluoride. A white opaque film formed by using a synthesized resin containing a white pigment or a filler may be employed without any limitation.

A laminated substrate constituted by a combination of the above materials may also be employed. Typical examples of a laminated substrate include: a combination of cellulose fiber paper and synthesized paper; and a combination of cellulose synthesized paper and a plastic film. The thickness of a substrate is not specifically limited, but usually 10 to 300 mm.

The presence of a layer having micro voids in the substrate is preferable for obtaining a high printing sensitivity and a high image quality without unevenness of density and white spots in image. For the layer having the micro voids, a plastic film and synthesized paper each having the micro voids therein can be employed. When the plastic film or the synthesized paper each having micro voids is employed, a mixture of a polyolefin, specifically polypropylene is preferably used as a principal material, and inorganic pigment and/or a polymer non-miscible with polypropylene is blended with the principal material to be employed as a void formation initiator. The mixture is stretched and formed into a film to obtain a plastic film or synthesized paper. When the layer is principally formed by using polyester resin, the cushion property and the heat insulation property are inferior to those principally formed by polypropylene because of the viscoelasticity and the thermal property of polyester. Therefore, the film principally formed by the polyester resin is inferior in the printing sensitivity and the unevenness in the image.

Considering these points, the elastic modulus of the film or synthesized paper is preferably from $5\times10^8$ Pa to $1\times10^{10}$ Pa at 20° C. These film and synthesized paper shrinks by heating because they are usually produced by 2-axis stretching. The shrinking ratio of the film or the synthesized paper after standing for 60 minutes at 110° C. is 0.5 to 2.5%.

The plastic film or the synthesized paper may have a single layer structure containing the micro voids itself or a plural-layer structured. In the case of a plural-layer structure, the entire layers may contain micro voids or a layer containing no void may be included. A white pigment may be added to the plastic film or the synthesized paper as a masking agent. An additive such as a fluorescent whitening agent may also be contained for increasing the whiteness. The thickness of the layer containing the micro voids is preferably 30 to 80 μm.

Moreover, a layer of resin such as polyvinyl alcohol, polyvinylidene chloride, polyethylene, polypropylene, a modified polyolefin, polyethylene terephthalate and polycarbonate or a layer of synthesized paper may be provided on the surface of the substrate opposite to the surface on which the image receiving layer is coated, for preventing the curling. For pasting the layer, for example, known lamination methods such as a dry lamination, non-solvent (hot-melt) lamination and EC lamination are applicable, and the dry lamination method and the non-solvent lamination method are preferable. As the adhesive suitable for the non-solvent lamination method, for example, Takenate 720L, manufactured by Takeda Chemical Industries, Ltd., is cited, and that suitable for the dry lamination, for example, Takelac A969/Takenate A-5 (3/1), manufactured by Takeda Chemical Industries, Ltd., Polysol PSA SE-1400 and Vinylol PSA AV-6200, manufactured by Showa Highpolymer Co., Ltd., are cited. The using amount of such the adhesives is from about 1 to 8 g/m$^2$, preferably from 2 to 6 g/m$^2$, based on solid content.

For laminating the above plastic film and the synthesized paper or themselves, or various kinds of paper and the plastic film or the synthesized paper, an adhesive can be employed.

The surface of the substrate is preferably subjected to various kinds of primer treatments or corona discharge treatment for increasing the adhesion strength of the substrate with the intermediate layer or the image receiving layer.

Among the above-described substrates, resin coated paper having a thickness of from 50 to 250 μm coated with plastic resin on the both surfaces thereof is preferably employed in the invention. Resin coated paper having a thickness of from 50 to 250 μm coated with polyolefin resin on the both surfaces thereof is further preferable.

The resin coated paper coated with the polyolefin resin on the both surfaces of the paper specifically preferred in the invention is described below.

The paper employed in the resin coated paper of the invention is made employing wood pulp as the principal raw material and adding according to necessity synthesized pulp of polypropylene or synthesized fiber such as nylon or polyester. As the wood pulp, LBKP, LBSP, NBKP, NBSP, LDP, NDP, LUKP and NUKP are usable, and it is preferable to mainly employ LBKP, NBSP, LBSP, NDP and LDP which contain much short fibers. The ratio of LBSP and /or LDP is preferably from 10 to 70%. In the above pulps, a chemical pulp such as sulfate pulp and sulfite pulp with a low content of impurities is preferably employed and, a bleached pulp for increasing the whiteness is also useful.

To the paper, for example, a sizing agent such as a higher fatty acid and an alkylketen dimer, a white pigment such as calcium carbonate, talc and titanium oxide, a paper strengthen agent such as starch, polyacrylamide and polyvinyl alcohol, a fluorescent whitening agent, a moisture holding agent such as polyethylene glycol, a dispersant and a softening agent such as a quaternary ammonium can be optionally added.

The degree of filtration of the pulp to be employed for paper making is preferably from 200 to 500 ml defined by the standard of CSF is preferable, and the length of the fiber after beating is preferably from 30 to 70% in terms of the sum of a 24 mesh remaining amount and a 42 mesh remaining amount defined in JIS P 8207, and a 4 mesh remaining amount is preferably not more than 20%.

The weight of the paper is preferably from 50 to 250 g/m$^2$, specifically preferably from 70 to 200 g/m$^2$, and the thickness of the paper is preferably from 50 to 250 μm.

The paper can be given high glossiness by calendar treatment before or after the paper making. The density of the paper is usually from 0.7 to 1.2 g/cm$^3$ (JIS P 8118). The stiffness of the raw paper is preferably from 20 to 200 g under the condition defined by JIS P 8143.

A surface sizing agent may be coated on the surface of the paper; as the surface sizing agent, one the same as the sizing agent added into the raw paper.

The pH of the paper is preferably from 5 to 9 measured by the hot water extraction method defined by JIS P 8113.

The polyolefin resin to be employed for covering the both surfaces of the paper is described below. Polyolefin resin usable for this purpose include polyethylene, polypropylene and polyisobutylene. Polyolefin such as a copolymer mainly composed of polypropylene is preferable, and polyethylene is specifically preferable.

Specifically preferable polyethylene is described below. The polyethylene covering the surface and the back surface of the paper is mainly a low density polyethylene (LDPE) and/or a high density polyethylene (HDPE), and another resin such as a LLDPE and polypropylene may also be partially employed.

It is preferable to add rutile type or anatase type titanium oxide into the polyolefin layer covering on the surface of the paper on which the coating layer is provided for improving the whiteness and opacity. The content of the titanium oxide to the polyolefin is usually from 1 to 20%, and preferably from 2 to 15%.

In the polyolefin layer, a heat resistant colored pigment and fluorescent whitening agent can be added for controlling the whiteness of the background.

Examples of the colored pigment include ultramarine blue, prussian blue, cobalt blue, phthalocyanine blue, manganese blue, cerulean blue, tungsten blue, molybdenum blue and anthraquinone blue.

Examples of the fluorescent whitening agent include a dialkylaminocumalin, bis-dimethylaminostilbene, bis-methylaminostilbene, a 4-alkoxy-1,8-naphthalenedicarboxylic acid N-alkylimide, bis-benzoxazolylethylene and a dialkylstilbene.

The using amounts of the polyethylene on the surface and the back surface of the paper are decided depending on the entire layer thickness of the image receiving layer side so as to optimize the curling of the sheet under low and high humidity conditions after providing the backing layer. The thickness of the polyethylene layer is usually 15 to 50 μm on the image receiving layer side surface and 10 to 40 μm on the backing layer side surface. The ratio of the polyethylene on the surface to that on the back surface is preferably decided for controlling the curl which is varied depending on the kind and thickness of the image receiving layer and the thickness of the raw paper. The ratio of polyethylene, surface/back, is approximately from 3/1 to 1/3 in thickness.

The foregoing polyethylene laminated paper preferably has characteristics of the following 1 to 7.

1. Tensile strength: Preferably from 19.6 to 294 N in the longitudinal direction and from 9.8 to 196 N in the lateral direction in the strength defined in JIS P 8113;

2. Tear strength: Preferably from 0.20 to 2.94 N in the longitudinal direction and from 0.098 to 2.45 N in the lateral direction in the strength defined in JIS P 8116;

3. Compressive elasticity: Preferably 9.8 $kN/cm^2$;

4. Opacity: Preferably not less than 80%, and specifically preferably from 85 to 98% measured by the method defined in JIS P 8138;

5. Whiteness: Preferably $L^*=80$ to 96, $a^*=-3$ to +5, $b^*=-7$ to +2 in $L^*,a^*,b^*$ defined in JIS Z 8727;

6. Clark's stiffness: A substrate having a Clark's stiffness of from 50 to 300 $cm^3/100$ in the conveying direction of the recording paper is preferable;

7: The moisture content of the paper is preferably from 4 to 10% of the raw paper; and 8. Glossiness before providing the image receiving layer is preferably from 10 to 90% of the 75° mirror face glossiness.

In the thermal transfer image receiving sheet of the invention, the method for coating the layers to be provided according to necessity such as the porous layer and a subbing layer onto the substrate can be optionally selected from known methods. As the preferable methods, the coating liquids for forming each layer are coated on the substrate and dried. In the coating method, two or more layers can be simultaneously coated, and the coating method in which the entire layers are coated at once is specifically preferable.

A roller coating method, a rod bar coating method, an air knife coating method, a spray coating method, a curtain coating method and an extrusion coating method using a hopper described in U.S. Pat. No. 2,681,294 are preferably applied.

(Porous Intermediate Layer)

In the thermal transfer image receiving sheet of the invention, the porous intermediate layer having a void ratio of not less than 30% and containing at least one kind of inorganic microparticles is provided on the substrate by a coating method.

(Inorganic Microparticles)

Examples of inorganic microparticles to be contained in the porous intermediate layer of the invention include white inorganic pigments, for example: light calcium carbonate, heavy calcium carbonate, magnesium carbonate, kaolin, clay, talc, calcium sulfate, barium sulfate, titania (titanium dioxide), zinc oxide, zinc hydroxide, zinc sulfide, zinc carbonate, hydrotalcite, aluminum silicate, synthesized amorphous silica, colloidal silica, alumina, colloidal alumina, pseudoboehmirte, aluminum hydroxide, lithopone, zeolite and magnesium hydroxide.

The inorganic microparticles may be employed either in a state of uniformly dispersed in a binder in a form of primary particle or in a form of secondary coagulated particle. The later is preferable from the viewpoint of attaining the high heat insulation and cushion property.

The inorganic microparticles may has any shape such as spherical, rod-like, needle-like, planar, rosary-like and hollow particle without any limitation, and their combination is also employable.

Among the foregoing inorganic microparticles, silica, alumina, titania and a combination thereof are preferable for the inorganic microparticles of the invention from the viewpoint of cost performance. The average diameter of the primary particles is preferably from 3 to 100 nm since the porous structure having high heat insulation property can be easily formed by such particles.

As the inorganic microparticles, solid microparticles selected from silica, alumina and hydrated alumina is specifically preferable.

Silica synthesized by an ordinary wet method, colloidal silica and silica synthesized by a gas phase method are preferably employed in the invention, and the microparticles of silica synthesized by the gas phase method is specifically preferably employed in the invention. The silica synthesized by gas phase method is preferable since not only high void ratio is obtained but also coarse coagula tends not to be formed.

Alumina and the hydrated alumina may be either crystalline or amorphous, and optional shaped alimina such as irregular particle, spherical particle and needle-like particle may be employed.

Microparticles of the invention are preferably dispersed in a state of primary particles before being mixed with a binder which will be described later.

The diameter of the primary particle is preferably not more than 100 nm as described above. For example, in the case of silica microparticles prepared by the gas phase method, the average diameter of the primary particles in the dispersed state (the particle diameter in the dispersed liquid before coating) is preferably from 3 to 20 nm, and most preferably from 4 to 20 nm.

Examples of the silica synthesized by the gas phase method having an average diameter of the primary particle of from 4 to 20 nm, which are most preferably employed, include Aerosil manufactured by Aerosil Co., Ltd., Cabosil manufactured by Cabot Co., Ltd., and Rheoloseal manufactured by Tokuyama Corp., they are available on the market. Such the gas phase method silica microparticles can be relatively easily dispersed by near primary particle state by suction dispersing by a jet stream inductor mixer manufactured by Mitamura Riken Kogyo Co., Ltd.

(Binder)

The binder for the porous intermediate layer is described below.

The binder employable in the porous intermediate layer of the invention may be either hydrophilic, hydrophobic or a combination thereof, however, an emulsion resin formed by emulsion polymerization using a polymer dispersant having a hydroxyl group or a hydrophilic binder is preferable.

Polyvinyl alcohol is specifically preferable as a polymer dispersant for the emulsion resin formed by emulsion polymerization using a polymer dispersant having a hydroxyl group, which is a hydrophobic binder. The minimum film forming temperature (Tg) is preferably not more than 20° C. for film forming at an ambient temperature, and more preferably not more than 5° C. The average particle diameter of the emulsion resin is preferable from 0.01 to 2 μm, and specifically preferably from 0.05 to 1.5 μm. Examples of such emulsion resin available on the market include vinyl acetate emulsions Vinysol 480 and 2023, manufactured by Daido Kagaku Kogyo Co., Ltd., vinyl acetate emulsions Vinyblan 1108W and 1084W, and acryl resin emulsion Vinyblan 2597 and 2561, manufactured by Nisshin Kagaku Kogyo Co., Ltd., and vinyl acetate-ethylene resin emulsions Sumikaflex S-400 and 405,manufactured by Sumitomo Kagaku Kogyo Co., Ltd.

Examples of the hydrophilic binder of the porous intermediate layer of the invention include: gelatin, polyvinyl alcohol, polyethylene oxide, polyvinyl pyrrolidone, pluran, carboxymethyl cellulose, hydroxyethyl cellulose, dextran, dextrin, polyacrylic acid and its salt, agar, κ-karaginan, λ-karaginan, ι-karaginan, casein, xanthen gum, locust bean gum, alginic acid, gum arabic, polyalkylene oxide copolymers described in JP-A Nos. 7-195826 and 7-9757, and homopolymer or copolymer of vinyl monomer having a carboxyl group or a sulfonic acid group described in JP-A No. 62-245260. These binders may be used alone or in combination of two or more kinds thereof. The hydrophilic binder preferably employed in the invention is polyvinyl alcohol.

Examples of polyvinyl alcohol includes: a modified polyvinyl alcohol such as a cationic modified polyvinyl alcohol, an anionic modified polyvinyl alcohol having an anionic group, and a silyl modified polyvinyl alcohol substituted by a silyl group.

The polyvinyl alcohol to be employed together with the emulsion resin is preferably the one having an average polymerization degree of not less than 300, and specifically preferably the one having an average polymerization degree of 1,000 to 5,000. The saponification degree is preferably from 70 to 100 percent by mole, and specifically preferably from 80 to 99.5 percent by mole.

When the hydrophilic binder or the hydrophobic binder is employed in combination with the emulsion resin, the ratio of the emulsion resin prepared by emulsion polymerization using a polymer dispersant containing a hydroxyl group in the binder is preferably not less than 5% by weight, and specifically preferably not less than 10% by weight.

A cationic polymer can be employed in the porous intermediate layer of the invention. The cationic polymer is a polymer having a primary, secondary or tertiary amine group, a quaternary ammonium group or a quaternary phosphonium group on the principal chain or a side chain thereof.

Examples of the cationic polymer include polyethyleneimine, polyallylamine, polyvinylamine, a dicyandiamide-polyalkylene polyamine condensation product, a polyalkylene polyamine dicyandiamide ammonium salt condensation product, a dicyandiamide formalin condensation product, an epichlorohydrine.dialkylamine addition polymer, a diallyldimethylammonium chloride polymer, a diallyldimethylammonium chloride.$SO_2$ copolymer, polyvinylimidazole, a vinylpyrrolidone.vinylimidazole copolymer, polyvinylpyridine, polyamidine, chitosan, cationic starch, a vinylbenzyltrimethylammonium chloride polymer, a (2-methacroyloxyethyl)trimethylammonium chloride polymer and a dimethylaminoethyl methacrylate polymer.

The cationic polymer employable in the invention is preferably unswellable, and a cationic polymer copolymerized with an acrylic acid is specifically preferred. As the acrylic acid, an acrylic acid ester and an acrylamide are applicable and butyl acrylate and hydroxyethylmethyl acrylate are preferable.

Moreover, cationic polymers described in "Kagaku Kogyo Joho" published on Aug. 15 and 25 in 1998, and polymer dye-fixing agents described in "Kobunshi Yakuzai Nyumon" published by Sanyo Chemical Industries, Ltd., may be listed.

The weight average molecular weight of the cationic polymer employable in the invention is preferably from 2,000 to 500,000, and more preferably from 3,000 to 100,000.

The cationic polymer employable in the invention may be (i) previously added to the coating liquid and then coated and dried; (ii) added by immersing the coated and dried porous intermediate layer in an aqueous solution of the cationic polymer; or (iii) added after the coating liquid of the porous intermediate layer is applied on the substrate before drying. As the method for adding the cationic polymer to the coated porous intermediate layer before drying, a curtain coating and a spray coating are applicable.

When the cationic polymer employable in the invention is previously added to the coating liquid, the cationic polymer may be uniformly added to the coating liquid or also may be added as composite particles with inorganic microparticles. Methods for forming the composite particles of inorganic particles and the cationic polymer include: (i) a method in which the inorganic microparticles are mixed with the cationic polymer so that the surfaces of the microparticles are covered with the cationic polymer by absorption; (ii) a method in which the above mentioned covered microparticles are further coagulated so as to form a higher order composite particle; and (iii) a method in which thus obtained coarse particles are dispersed as uniform particles using a homogenizer.

The cationic polymer used in the invention is usually water-miscible since it has a water-soluble group, however, there are some cationic polymers which are not soluble in water according to the composition of the copolymer. With respect to the production process, the water soluble cationic polymer is preferable, however, even if a cationic polymer is insoluble in water, it may be dissolved in aqueous solution by using a water-miscible organic solvent.

The water-miscible organic solvent is an organic solvent capable of being dissolved in water in a ratio of approximately not less than 10%, for example: alcohols such as methanol, ethanol, iso-propanol and n-propanol; glycols such as ethylene glycol, diethylene glycol and glycerin; esters such as ethyl acetate and propyl acetate; ketones such as acetone and methyl ethyl ketone; and amides such as N,N-dimethylformamide. The amount of the water-miscible organic solvent is preferably smaller than that of water.

The cationic polymer is usually employed within the range of from 0.1 to 10 g, and preferably from 0.2 to 5 g, per square meter of the thermal transfer image receiving sheet.

The adding amount of the foregoing inorganic microparticles is usually from 3 to 30 g, and preferably from 5 to 25 g, per square meter of the thermal transfer image receiving sheet. The ratio of the inorganic microparticles to the binder is preferable from 2:1 to 20:1, specifically from 5:1 to 12:1.

In the invention, the void ratio in the porous intermediate layer is not less than 30%, and is preferably controlled to within the range of from 30 to 85%. When the void ratio is less than 30%, the heat insulation/cushion function cannot be sufficiently attained, and when the ratio is more than 85%, the heat insulation effect is not effectively increased and the degradation in the mechanical strength becomes notable. The void ratio is a ratio of the entire volume of the void in the volume of the void including layer, and the ratio can be calculated by the entire volume of the composition of the layer and the thickness of the layer. The void ratio can be optionally controlled depending on the kind of the inorganic microparticles and the binder, and the amount of other additive.

The viscosity of the coating liquid of a layer to be provided on the porous intermediate layer is preferably not less than 30 mPa·s, more preferably from 30 to 100 mPa·s, and still more preferably from 30 to 80 mPa·s, in order to control the formation of bubbles caused by the porous intermediate layer as little as possible in the production process of the thermal transfer image receiving sheet of the invention. Also, in the same purpose, it is preferable that the ratio of the solid component in the porous intermediate layer is preferably not more than 80% by weight, more preferably not more than 70% by weight, and specifically preferably from 20 to 70% by weight, at the time of coating the layer on the porous intermediate layer.

In the invention, a second intermediate layer is preferably provided between the porous intermediate layer and the image receiving layer additionally to the porous intermediate layer.

As the function of the second intermediate layer, solvent proof property, barrier property, adhesion property, whitening property, masking property and antistatic property can be cited; however, the function of the layer is not limited to the above described properties. Known intermediate layers can be entirely applicable.

For providing a solvent proof property and a barrier property to the second intermediate layer, the use of a water-soluble resin is preferable. Examples of the water-soluble resin include: a cellulose resin such as carboxymethyl cellulose, a polysaccharide resin such as starch, a protein such as casein, gelatin, agar, some of vinyl resins such as polyvinyl alcohol, a hydrophobic resin modified to provide a water soluble property, and a dispersed resin. Here, the water soluble polymer denotes a polymer capable of being a state of: a complete solution (particle diameter of not more than 0.01 μm), a colloidal dispersion (particle diameter-of from 0.01 to 0. 1 μm), an emulsion (0.1 to 1 μm) or a slurry (mot less than 1 μm) in a solvent containing water as a main component. Among these water-soluble resins, specifically preferable is a resin which is not only insoluble but also non-swellable to a common solvent, for example, alcohols such as methanol, ethanol and isopropyl alcohol; hexane; cyclohexane; acetone; methyl ethyl ketone; xylene; ethyl acetate; butyl acetate; or toluene. In this point of view, most preferable is a resin which is completely soluble to a solvent containing water as a main component. Specifically, polyvinyl alcohol and a cellulose resin are preferable.

For providing the adhesion property to the second intermediate layer, a urethane resin and a polyolefin resin are usually applied. Sufficient adhesion property can be obtained by the combination of a thermoplastic resin having a activated hydrogen and a hardening agent such as an isocyanate compound even though the effect is varied depending on the kind of the substrate sheet or the surface treatment thereof. For providing the whitening property to the second intermediate layer, a fluorescent whitening agent can be employed. Any compounds know as the fluorescent whitening agent can be employed, for example, stilbene type, distilbene type, benzoxazole type, styryl-oxazole type, pyrene-oxazole type, coumalin type, aminocoumalin type, imidazole type, benzimidazole type, pyrazoline type and styryl-biphenyl type fluorescent whitening agents are usable. The whiteness can be controlled by the kind and the adding amount of the fluorescent whitening agent. As the method of adding the fluorescent whitening agent, any method can be applied without any limitation. The examples of adding method include a method by dissolving in water, a method by crushing and dispersing by a ball mill or a colloid mill, a method in which the whitening agent is dissolved in a high-boiling point solvent and mixed with a hydrophilic colloid solution to form an oil-in-water dispersion for addition and a method by impregnating in a polymer latex.

Titanium oxide may be added to the second intermediate layer in order to reduce the glare and to cover the unevenness of the substrate sheet. The use of the titanium oxide is preferable since the selectivity of the substrate sheet is expanded. Titanium oxides include rutile type titanium oxide and anatase type titanium oxide. Among these, anatase type titanium oxide having shorter wavelength of UV absorption compared to that of rutile type titanium oxide is preferable in view of the whiteness and the effect of a fluorescent whitening agent. When the binder resin of the second intermediate layer is hydrophilic and the titanium oxide is difficult to be dispersed in the binder, the titanium oxide can be dispersed by using titanium oxide treated by a hydrophilizing treatment or by using known dispersant such as a surfactant or ethylene glycol. The adding amount of the titanium oxide is preferably from 10 to 400 weight parts in 100 weight parts of the solid portion of the resin.

For providing an antistatic property to the second intermediate layer, a usually known electroconductive material such as an electroconductive inorganic filler, an electroconductive organic material such as polyaniline sulfonate can be optionally selected and employed together with the binder resin. The thickness of the second intermediate layer is preferably from 0.1 to 10 μm.

Microparticles such as hollow particles are preferably added to the second intermediate layer for increasing the moisture proof property and for obtaining high printing sensitivity by sealing the voids in the image receiving layer side surface of the porous intermediate layer. The hollow particle may be employed singly or in combination with the usually used titanium oxide.

(Image Receiving Layer)

The binder resin, the metal ion-containing compound reacting with a chelate formable dye to form a chelate compound and the release agent to be used in the image receiving layer of the invention are described below.

<Binder Resin>

For the binder resin to be employed in the image receiving layer of the invention, any known binder resin are applicable, and resins easily dyed by a coloring matter (hereinafter referred to as a dye) are preferably employed. In concrete, a polyolefin resin such as polypropylene, a halide resin such as polyvinyl chloride and Polyvinylidene chloride, a vinyl resin such as polyvinyl acetate and a Polyacrylate, a polyester resin such as polyethylene terephthalate and polybutylene terephthalate, a polystyrene resin, a polyamide resin, a phenoxy resin, a copolymer of olefin such as ethylene and propylene and another vinyl monomer, polyurethane, polycarbonate, an ionomer, a cellulose derivative and their mixture are usable. Among these, the vinyl resin is preferable, and the polyester resin, cellulose resin and polycarbonate are most preferable.

Examples of other binder resin include: the above mentioned hydrophobic binders for the porous intermediate layer, hydrophilic binders which will be described later, and a combination thereof.

Examples of the usable hydrophilic binder which may be used in combination include gelatin, polyvinyl alcohol, polyvinylpyrrolidone, polyethylene oxide, hydroxyethyl cellulose, agar, pluran, dextrin, acrylic acid, carboxymethyl cellulose, casein and alginic acid, and two or more kinds of them may be usable in combination. Among them, the preferable binder is polyvinyl alcohol.

The above polyvinyl alcohol includes modified polyvinyl alcohols such as a cationic modified polyvinyl alcohol, an anionic modified polyvinyl alcohol having an anionic group, a polyvinyl acetal resin which is an acetalized polyvinyl alcohol and a silyl modified polyvinyl alcohol substituted by a silyl group.

The average polymerization degree of the polyvinyl alcohol to be employed together with the emulsion resin is preferably not less than 300, and specifically preferably from 1,000 to 5,000. The saponification degree is preferably from 70 to 100% by mole, and specifically preferably from 80 to 99.5% by mole.

When the hydrophilic binder or the hydrophobic binder is employed in combination with the emulsion resin, the ratio of the emulsion resin prepared by emulsion polymerization by the polymer dispersant containing a hydroxyl group in the binder is preferably not less than 5% by weight, and specifically preferably not less than 10% by weight.

The cationic polymers relating to the invention are common to the above mentioned cationic polymers usable for the porous intermediate layer.

The cationic polymer used in the invention is usually water-miscible since it has a water-soluble group, however, there are some cationic polymers which are not soluble in water according to the composition of the copolymer. With respect to the production process, the water soluble cationic polymer is preferable, however, even if a cationic polymer is insoluble in water, it may be dissolved in aqueous solution by using a water-miscible organic solvent.

The water miscible organic solvent is an organic solvent capable of being dissolved in water in a ratio of approximately not less than 10%, for example, alcohols such as methanol, ethanol, iso-propanol and n-propanol; glycols such as ethylene glycol, diethylene glycol and glyceri; esters such as ethyl acetate and propyl acetate; ketones such as acetone and methyl ethyl ketone; and amides such as N,N-dimethylformamide. In such the case, the employing amount of the water miscible organic solvent is preferably smaller than the employing amount of water.

The cationic polymer is usually employed within the range of from 0.1 to 10 g, and preferably from 0.2 to 5 g, per square meter of the thermal transfer image receiving sheet.

<Metal Ion-Containing Compound Capable of Forming a Chelate Compound by Reaction with a Chelate Formable Dye>

As the metal ion-containing compound capable of forming a chelate compound reacting with a chelate formable dye (hereinafter referred to as a metal source) contained in the image receiving layer of the thermal transfer image receiving sheet of the invention, an inorganic or organic salt of a metal ion and a metal complex are employable, among them an inorganic salt is preferred. Mono-valent and multi-valent metals included in Groups I through VIII of the periodical table are usable as the metal, and Al, Co, Cr, Cu, Fe, Mg, Mn, No, Ni, Sn and Zn are preferable and Ni, Cu, Cr, Co and Zn are specifically preferable.

Concrete examples of the metal source include an inorganic salt, a salt of an aliphatic acid such as acetic acid or stearic acid, and a salt of an aromatic carboxylic acid such as benzoic acid or alicylic acid, with $Ni^{2+}$, $Cu^{2+}$, $Cr^{2+}$, $Co^{2+}$ or $Zn^{2+}$.

In the invention, a complex represented by the following Formula I is specifically preferably employed since the complex can be stably added to the image receiving layer and is substantially colorless.

Formula I $$[M(Q_1)_X(Q_2)_Y(Q_3)_Z]^{P+}(L^-)_P \qquad \text{I}$$

In the above formula, M is a metal ion, preferably $Ni^{2+}$, $Cu^{2+}$, $Cr^{2+}$, $Co^{2+}$ or $Zn^{2+}$, and $Q_1$, $Q_2$ and $Q_3$ each represent a coordination compound capable of forming a coordinate bond with the metal ion represented by M. $Q_1$, $Q_2$ and $Q_3$ may be the same or different. The coordination compound can be selected, for example, from those described in "Kireito Kagaku (Science of Chelate)" published by Konando. $L^-$ is an organic anionic group such as a tetraphenyl boron anion and an alkylbenzenesulfonate anion. X is an integer of 1, 2 or 3, Y is 0, 1 or 2 and Z is 0 or 1, and they are decided depending on that the complex represented by Formula I is tetradentate coordination or hexadentate coordination complex or the number of ligand represented by $Q_1$, $Q_2$ and $Q_3$. P is an integer of 1 or 2. As concrete examples of such metal source, compounds described in U. S. Pat. No. 4,987,049 and Compounds 1 through 51 described in JP-A 10-67181 can be cited.

The adding amount of the metal source is usually from 5 to 80% and further preferably from 10 to 70% based on the weight of the binder of the image receiving layer. The adding amount of the metal source in the invention is preferably from 0.5 to 20 g/m$^2$ and further preferably from 1 to 15 g/m$^2$.

<Release Agent>

Addition of a release agent to the image receiving layer for preventing the thermal fusion with the ink layer of the thermal transfer ink sheet on the occasion of printing is one of the characteristics of the image receiving layer of the invention. A silicone emulsion release agent or a water-soluble release agent is preferably used.

A phosphoric acid ester plasticizer, a fluorine-containing compound and silicone oil (including a reaction curable silicone) can be employed for the release agent. Of these, silicone oil is preferable. As the silicone oil, various modified silicone including dimethylsilicone can be employed. In concrete, an amino-modified silicone, an epoxy-modified silicone, an alcohol-modified silicone, a vinyl-modified silicone or a urethane-modified silicone are usable. These silicones may be blended or polymerized via various reactions. The release agent is used alone or in combination of two or more kinds thereof. The adding amount of the release agent is preferably from 0.5 to 30 weight parts in 100 weight parts of the resin constituting the image receiving layer. When the adding amount of the release agent is out of the above range, the fusion of the thermal transfer ink sheet with the image receiving sheet tends to occur and and the printing sensitivity may be lowered. The release agent may be separately provided as a releasing layer on the image receiving layer in which no release agent is contained.

In the invention, a silicone emulsion release agent is preferably employed. The silicone emulsion release agent is a silicone emulsion prepared by emulsifying silicone oil by various emulsifying agents. A silicone emulsion release agent of oil emulsion (O/W) type is preferred. In concrete, KM786, KM578 and KM860, manufactured by Shin-Etsu Chemical Co., Ltd., are usable. The emulsion type silicone release agent may be employed alone or in combination of two or more kinds thereof. The silicone emulsion type release agent may be employed together with another silicone oil release agent.

These release agents may be separately provided as a releasing layer provided on the image receiving layer containing no release agent.

<Silicone Surfactant>

The image receiving layer of the invention preferably contains a silicone surfactant.

In the invention, any known silicone surfactants can be employed. For example, those disclosed in "Kinousei Kaimenn Kasseizai (Functional Surfactant)" edited by M. Tsunoda, Section 6, August 2000, are preferably employed. In concrete, Emalex SS-5050K and Emalex SS-5602, manufactured by Nihon Emulsion Co., Ltd., are employable.

<Fluorinated Surfactant>

In the image receiving layer of the invention preferably contains a fluorinated surfactant.

In the invention, any known fluorinated surfactant can be employed. For example, those disclosed in "Kinnousei Kaimenn Kasseizai (Functional Surfactant)" edited by M. Tsunoda, Section 5, August 2000, are preferably employed. In concrete, Ftergent series manufactured by Neos Co., Ltd. and FC-4430 manufactured by Sumitomo 3M Co., Ltd. are employable.

<Hardening Agent>

In the thermal transfer image receiving sheet, the porous intermediate layer or the dye receiving layer preferably contains a hardening agent. The hardening agent can be added at optional step of the production of the thermal transfer image receiving sheet, for example, it can be added to the coating liquid of the porous intermediate layer.

The hardening agent usable in the invention is not specifically limited as long as it is reactive with the binder and conducts a hardening reaction. Boric acid and its salt, and an epoxy type hardening agent are preferable, and other known hardening agent may also be employed. Generally, a hardening agent is a compound having a group capable of reacting with the binder or a compound capable of accelerating the reaction between different groups in the hydrophilic binder, and is optionally selected for use corresponding to the kind of the binder. Concrete examples of the hardening agent include epoxy type hardening agents (such as diglycidyl ethyl ether, ethylene glycol diglycidyl ether, 1,4-butanediol glycidyl ether, 1,6-diglycidylcyclohexane, N,N-diglycidyl-4-glycidyloxyaniline, sorbitol polyglycidyl ether and glycerol polyglycidyl ether); aldehyde hardening agents (such as formaldehyde and glyoxal); reactive halogen hardening agents (such as 2,4-dichloro-4-hydroxy-1,3,5-s-triazine); reactive vinyl compounds (such as 1,3,5-trisacryloyl-hexahydro-s-triazine and bisvinylsulfonylmethyl ether); isocyanate compounds, zyrconyl sulfate and aluminum alum.

"Boric acid and its salt" represents an oxygen acid containing a boron atom as the central atom and a salt thereof. Concretely, orthoboric acid, diboric acid, metaboric acid, tetraboric acid, pentaboric acid and octaboric acid and a salt thereof are included.

The boric acid and its salt having a boric atom as a hardening agent may be employed as a solution using single organic solvent or as an aqueous solution, and may be employed as a solution containing a mixture of two or more kinds of boric compounds. An aqueous solution of a mixture of boric acid and borax is specifically preferable.

Though boric acid and borax each can be added only as a diluted aqueous solution, a concentrated aqueous solution can be-obtained by mixing these two compounds so that a concentrated coating liquid can be prepared. Moreover, it is an advantage that the pH of the aqueous solution can be relatively freely controlled.

The total using amount of the hardening agent is preferably from 1 to 1,000 mg per 1 g of the binder. The supplying amount of the hardening agent is preferably from 100 to 1,000 mg per 1 g of the binder.

<Thermal Conductivity>

One of the characteristic features of the thermal transfer image receiving sheet of the invention is that the thermal conductivity is not more than 0.35 W/mK.

In the invention, the thermal conductivity κ (W/mK) is an amount of heat flowed through 1 $m^2$ of a plate, of which the thickness is 1 m, when the difference of the temperature between the both ends of the plate is 1° C. The thermal conductivity can be measured by, for example, a high speed thermal conductivity meter QTM-500, manufactured by Kyoto Electronics Manufacturing Co., Ltd., using a automatic operation software for measuring thin layer SOFT-QTM5W. When a probe constituted of a heater strained along a straight line and a thermo couple is employed and a constant electric power (heat amount) is applier to the heater, the temperature of the heater is exponentially raised and the rising of the temperature has a linear relation with the logarithms of the time. The thermal conductivity of the sample of the thermal transfer image receiving sheet can be calculated on the slope of the linear line. A polyethylene form, silicon rubber and quartz glass are employed as reference plates and an average value of measurements of three times is defined as the thermal conductivity (W/mK).

The thermal conductivity of the thermal transfer image receiving sheet of the invention is not more than 0.35 W/mK, and, for high speed printing, preferably not more than 0.27 W/mK and more preferably 0.01 to 0.27 W/mK.

<pH of Image Receiving Layer Coating Liquid>

The pH value of the image receiving layer coating liquid for forming the thermal transfer image receiving layer is preferably not more than 8.0, and more preferably from 5.0 to 8.0, for enhancing the effects of the invention.

The typical example of the constitution of the above-described thermal transfer image receiving sheet of the invention is described below.

FIG. 1 shows a schematic cross section drawing of an example of the constitution of the thermal transfer image receiving sheet.

In FIG. 1, the thermal transfer image receiving sheet 1 is constituted by a resin coated paper 2 composed of a substrate material 3 covered by plastic resin 4 on the both surfaces and a porous intermediate layer 6 formed by coating on the resin coated paper through a subbing layer 5. In the porous intermediate layer, inorganic particles 7 are contained and voids are formed by the inorganic particles 7 and a binder. A second intermediate layer 8 is provided on the porous intermediated layer 6. In the invention, the viscosity of the coating liquid of the second intermediate layer is preferably not less than 30 mPa·s on the occasion of providing the second intermediate layer 8 on the porous intermediate layer 6.

An image receiving layer 9 is further provided on the second intermediate layer 8.

The thermal ink transfer is described below, which is employed together with the thermal transfer image receiving sheet according to the invention for image formation.

<<Thermal Transfer Ink Sheet>>

(Substrate Sheet)

In the invention, materials known as the substrate sheet for usual thermal transfer ink sheet can be employed. Examples of the preferable substrate sheet include (i) thin paper such as glassine paper, condenser paper and paraffin paper; (ii) polyester having high heat resistivity such as polyethylene terephthalate, polyethylene naphthalate, polybutylene terephthalate, polyphenylene sulfide, polyether ketone and polyether sulfone; (iii) stretched or non-stretched films of plastics such as polypropylene, a fluororesin, polycarbonate, cellulose acetate, a polyethylene derivative, polyvinyl chloride, polyvinylidene chloride, polystyrene, polyamide, polyimide, polymethylpentene and an ionomer; and (iv) a laminated product of these materials. The thickness of the substrate sheet can be selected according to the material so that the strength and the heat resistive property is optimized, and a substrate sheet having a thickness of 1 to 100 μm is preferably employed.

When the adhesion between the substrate sheet and the ink sheet formed on the sheet is insufficient, the surface is preferably subjected to a primer treatment or a corona treatment.

(Ink Layer and Colorant)

In the invention, the ink sheet constituting the thermal transfer ink sheet is a heat sublimation colorant layer containing a dye and a binder. The colorant to be used in the ink layer of the invention may be employed alone or in combination of plural kinds thereof.

The colorant employable in the invention is described below.

In the thermal transfer ink sheet of the invention, two or more colorant-containing areas different in the hue may be provided, for example, (i) an embodiment in which the colorant containing areas contain an yellow colorant-containing area, a magenta colorant-containing area and a cyan colorant-containing followed by a no colorant, (ii) an embodiment in which the colorant-containing area is constituted by a black colorant-containing area followed by a no colorant area, and (iii) an embodiment in which the colorant-containing areas contain a yellow colorant-containing area, a magenta colorant-containing area, a cyan colorant-containing area, a black colorant-containing area followed by a no colorant area.

For the colorant to be employed in the thermal sublimation colorant layer, any known colorant such as an azo colorant, an azomethine colorant, a methine colorant, an anthraquinone colorant, a quinophthalone colorant and a naphthoquinone colorant are usable, however, the invention is not limited thereto. In concrete, a yellow colorant such as Holonbrilliant Yellow 6GL, PTY-52 and Macrolex Yellow 6G; a red colorant such as MS Red G, Macrolex Red Violet R, Seles Red 7B, Samalon Red HBSL and SK Rubin SEGL; and a blue colorant such as Kayaset Blue 714, Waxolin Blue AP-FW, Holon Brilliant Blue S-R, MS Blue 100 and. Daito Blue No. 1 are cited.

As a chelate formable thermal diffusion colorant, various known compounds can be optionally selected for use without any limitation as long as the colorant can be thermally transferred. For example, the cyan, magenta and yellow colorants described in JP-A Nos. 59-78893, 59-109349, 4-94974 and 4-97894, and Japanese Patent No. 2856225 are employable.

For example, a compound represented by the following Formula (1) can be employed as the chelate formable cyan colorant.

Formula (1)

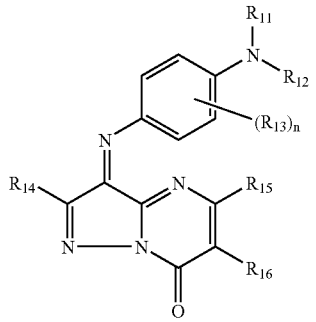

In the above Formula (1), $R_{11}$ and $R_{12}$ each represent a substituted or unsubstituted aliphatic group; $R_{11}$ and $R_{12}$ may be the same or different. Examples of the aliphatic group include: an alkyl group, a cycloalkyl group, an alkenyl group and an alkynyl group. Examples of the alkyl group include: a methyl group, an ethyl group and an i-propyl group, and examples of a group capable of being a substituent of the alkyl group include: a straight or branched chain alkyl group (such as a methyl group, an ethyl group, an i-propyl group, a t-butyl group, an n-dodecyl group and a 1-hexylnonyl group); a cycloalkyl group (such as a cyclopropyl group, a cyclohexyl group, a bicylo[2.2.1]heptyl group, and an adamantyl group); an alkenyl group (such as a 2-propylene group and an oleyl group); an aryl group (such as a phenyl group, an orthotolyl group, an orthoanisyl group, a 1-naphthyl group and a 9-anthranyl group); a heterocyclic group (such as a 2-tetrahydrofuryl group, a 2-thiophenyl group, a 4-imidazolyl group and 2-pyridyl group); a halogen atom (such as a fluorine atom, a chlorine atom and a bromine atom); a cyano group; a nitro group; a hydroxyl group; a carbonyl group (for example, an alkylcarbonyl group such as an acetyl group, a trifluoroacetyl group and a pivaloyl group, an arylcarbonyl group such as a benzoyl group, a pentafluorobenzoyl group and a 3,5-ditbutyl4-hydroxylbenzoyl group); an oxycarbonyl group (for example, an alkoxycarbonyl-group such as a methoxycarbonyl group, a cyclohexyloxycarbonyl group and an n-dodecyloxycarbonyl group, an aryloxycarbonyl group such as a phenoxycarbonyl group, 2,4-di-t-amylphenoxycarbonyl group and 1-naphthyloxycarbonyl group, and a heterocycolxycaronyl group such as a 2-pyridyloxycarbonyl group and 1-phenylpyrazolyl-5-oxycarbonyl group); a carbamoyl group (for example, an alkyl carbamoyl group such as a dimethylcarbambyl group and a 4-(2,4-di-t-amylphenoxy)butylaminocarbonyl group, and an arylcarbamoyl group such as a phenylcarbamoyl group and a 1-naphthylcarbamoyl group);

an alkoxyl group (such as a methoxy group and a 2-ethocyethoxy group); an aryloxy group (such as a phenoxy group, a 2,4-di-t-amylphenoxy group and a 4-(4-hydroxyphenylsulfonyl)phenoxy group); a hetercycloxy group (such as a 4-pyridyloxy group and a 2-hexahydropyranyloxy group); a carbonyloxy group (for example, an alkylcarbonyloxy group such as an acetyloxy group, a trifluoroacetyloxy group and a pivaloyloxy group, and an arylcarbonyloxy group such as a benzoyloxy group and a pentafluorobenzoyloxy group); a urethane group (for example, an alkylurethane group such as an N,N-dimethylurethane group, and an arylurethane group such as an N-phenylurethane and an N-(p-cyanophenyl)urethane group); a sulfonyloxy group (for example, an alkylsulfonyloxy group such as a methanesulfonyloxy group, a trifluoromethanesulfonyloxy group and a n-dodecanesulfonyloxy group, and an arylsulfonyloxy group such as a benzenesulfonyloxy group and a p-toluenesulfonyloxy group); an amino group (for example, an alkylamino group such as a dimethylamino group, a cyclohexylamino group and an n-dodecylamino group, and an arylamino group such as an aniline group and p-t-octylanilino group); a sulfonylamino group (for example, an alkylsulfonylamino group such as a methanesulphonylamino group, a heptafluoropropanesulfonylamino group and an n-hexadecylsulfonylamino group, and an arylsulfonylamino group such as a p-toluenesulfohylamino group and a pentafluorobenzenesulfonylamino group); a sulfamoylamino group (for example, an alkylsulfamoylamino group such as an N,N-dimethylsulfamoylamino group, and an arylsulfamoylamino group such as an N-phenylsulfamoylamino group); an acylamino group (for example, an alkylcarbonylamino group such as an acetylamino group and a myristoylamino group, and an arylcarbonylamino group such as an benzoylamino group); a ureido group (for example, an alkylureido group such as an N,N-dimethylaminoureido group, and an arylureido group such as an N-phenylureido group and an N-(p-cyanophenyl)ureido group); a sulfonyl group (for example, an alkylsulfonyl group such as a methanesulfonyl group and a trifluoromethanesulfonyl group, and an arylsulfonyl group such as a p-toluenesulfonyl group); a sulfamoyl group (for example, an alkylsulfamoyl group such as a dimethylsulfamoyl group and a 4-(2,4-di-t-amylphenoxy)butylaminosulfonyl group, and an arylsulfamoyl group such as a phenylsulfamoyl group); an alkylthio group (such as a methylthio group and a t-octylthio group); an arylthio group (such as a phenylthio group); and a heterocyclothio group (such as a 1-phenyltetrazole-5-thio group and 5-methyl-1,3,4-oxadiazole-2-tio group).

Examples of a cycloalkyl group and an alkenyl group are common to the above described substituent, and examples of an alkynyl group include a 1-propyne group, a 2-butyne group and a 1-hexyne group.

As the group represented by $R_{11}$ or $R_{12}$, a group having a non-aromatic ring structure such as a pyrrolidine ring, a piperidine ring and a morpholine ring is also preferable.

As $R_{13}$, an alkyl group, a cycloalkyl group, an alkoxyl group and an acylamino group are preferred among the above substituents. n is an integer of 0 to 4, and plural groups represented by $R_{13}$ may be the same or different when n is 2 or more.

$R_{14}$ is an alkyl group such as a methyl group, an ethyl group, an i-propyl group, a t-butyl group, an n-dodecyl group and a 1-hexylnonyl group. $R_{14}$ is preferably a secondary or tertiary alkyl group, and examples of them include an isopropyl group, a sec-butyl group, a tert-butyl group and 3-heptyl group. The most preferable group represented by $R_{14}$ is an isopropyl group and a tert-butyl group. The alkyl group represented by $R_{14}$ may be substituted by a substituent composed of a carbon atom and a hydrogen atom and not substituted by any group containing another atom.

$R_{15}$ is an alkyl group such as an i-propyl group, a t-butyl group, an n-dodecyl group and a 1-hexylnonyl group. $R_{15}$ is preferably a secondary or tertiary alkyl group, and examples of them include an isopropyl group, a sec-butyl group, a tert-butyl group and a 3-heptyl group. The most preferable group represented by $R_{15}$ is an isopropyl group and a tert-butyl group. The alkyl group represented by $R_{15}$ may be substituted by a substituent composed of a carbon atom and a hydrogen atom and not substituted by any group containing another atom.

$R_{16}$ is an alkyl group such as an n-propylgroup, an-butyl group, an n-pentyl group, an n-hexyl group, an n-heptyl group, an isopropyl group, a sec-butyl group, a tert-butyl group and a 3-heptyl group. Specifically preferable substituent represented by $R_{16}$ is a straight chain alkyl group having 3 or more carbon atoms, and examples of that include an n-propyl group, an n-butyl group, n-pentyl group, n-hexyl group and an n-heptyl group, and an n-propyl group and an n-butyl group are most preferable. The alkyl group represented by $R_{16}$ may be substituted by a substituent composed of a carbon atom and a hydrogen atom and not substituted by any group containing another atom.

As the yellow chelate formable colorant, a compound represented by the following Formula (2) can be cited.

Formula (2)

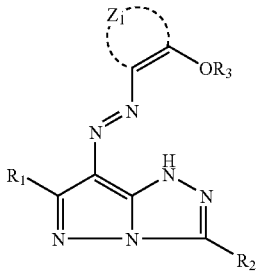

In Formula (2), the substituents represented by $R_1$ or $R_2$ are, for example, a halogen atom, an alkyl group or an alkyl group having 1 to 12 carbon atoms which may be substituted by a substituted bonding through an oxygen atom, a nitrogen atom, a sulfur atom or a carbonyl group, an aryl group, an alkenyl group, an alkynyl group, a hydroxyl group, an amino group, a nitro group, a carboxyl group, a cyano group or a halogen atom. Examples of the substituent include a methyl group, an isopropyl group, a t-butyl group, a trifluoromethyl group, a methoxymethyl group, a 2-methanesulfonylethyl group, 2-methanesulfonylamide group, a cyclohexyl group, an aryl group such as a phenyl group, a 4-t-butylphenyl group, a 3-nitrophenyl group, a 3-acylaminophenyl group and a 1-methoxyphenyl group, a cyano group, an alkoxyl group, an aryloxy group, an acylamino group, an anilino group, a ureido group, a sulfamoyl group, an alkylthio group, an arylthio group, an alkoxycarbonylamiho group, a sulfonamido group, a carbamoyl group, a sulfamoyl group, a sulfonyl group, an alkoxycarbonyl group, a heterocycloxy group, an acyloxy group, a carbamoyloxy group, a silyloxy group, an aryloxycarbonylamino group, an imido group, a heterocyclothio group, a sulfonyl group and an acyl group.

Alkyl groups and aryl groups represented by $R_3$ are common to the alkyl groups and aryl groups represented by $R_1$ or $R_2$.

Examples of the 5- or 6-member aromatic ring constituted together with the two carbon atoms represented by $Z_1$ include a ring of benzene, pyridine, pyrimidine, triazine, pyrazine, pyridazine, pyrrole, furan, thiophene, pyrazole, imidazole, triazole, oxazole and thiazole, these rings each may form a condensed ring with another aromatic ring. These rings may have a substituent thereon, and the examples of the substituent are common to those represented by $R_1$ or $R_2$.

As the magenta chelate formable colorant, a compound represented by the following Formula (3) can be cited.

Formula (3)

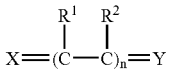

In the above Formula (3), X is a group or a group of atoms capable of forming a bidentate chelate, Y is a group of atoms necessary to form a 5- or 6-member aromatic hydrocarbon ring or a heterocyclic ring and $R^1$ and $R^2$ each represent a hydrogen atom, a halogen atom or a mono-valent substituent. n is 0, 1 or 2.

X is specifically preferably a group represented by the Following Formula (4).

Formula (4)

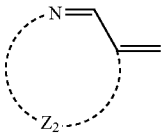

In the above Formula (4), $Z_2$ is a group of atoms necessary to form an aromatic nitrogen-containing heterocyclic ring substituted by a group which contains a nitrogen atom capable of forming at least one chelate. Concrete examples of the ring include a ring of pyridine, pyrimidine, thiazole and imidazole. These rings each may form a condensed ring together with a carbon ring such as a benzene ring or a heterocyclic ring such as a pyridine ring.

In the above Formula (3), Y is a group of atoms to form a 5- or 6-member aromatic hydrocarbon ring or a heterocyclic ring; these rings may have a substituted on the ring thereof and may have a condensed ring. Concrete examples of the ring include a 3H-pyrrole ring, an oxazole ring, an imidazole ring, a thiazole ring, a 3H-pyrrolidine ring, an oxazolidine ring, an imidazolidine ring, a thiazolidine ring, a 3H-indol ring, a benzoxazole ring, a benzimidazole ring, a benzothiazole ring, a quinoline ring and a pyridine ring. These rings each may form a condensed ring together with another carbon ring such as a benzene ring or a heterocyclic ring such as pyridine ring. Examples of a substituent of the ring include: an alkyl group, an aryl group, a heterocyclic group, an acyl group, an amino group, a nitro group, a cyano group, an acylamino group, an alkoxyl group, a hydroxyl group, an alkoxycarbonyl group and a halogen atom. These groups each may have further a substituent.

$R^1$ and $R^2$ each represent a hydrogen atom, a halogen atom such as a fluorine atom and a chlorine atom, or a mono-valent substituent. The mono-valent substituent is, for example, an alkyl group, an alkoxyl group, a cyano group, an alkoxycarbonyl group, an aryl group, a heterocyclic group, a carbamoyl group, a hydroxyl group, an acyl group and an acylamino group.

X represents a group or a group of atoms capable of forming at least one bidentate chelate, which may be one capable of forming a colorant of Formula (3), for example, 5-pyrazolone, imidazole, pyrazolopyrrole, pyrazolopyrazole, pyrazoloimidazole, pyrazotriazole, pyrazolotetrazole, barbituric acid, thiobarbituric acid, rhodanine, hydantoin, thiohydantoin, oxazolone, isooxazolone, indandione, pyrazolidinedione, hydroxypyridone and pyrazolipyridone are preferable.

(Binder Resin)

The ink layer of the invention contains a binder resin together with the foregoing colorant.

As the binder resin to be employed in the ink layer, a binder resin employed for a thermal transfer ink sheet to be used in a known thermal sublimation transfer method is applicable. For example, a water-soluble polymer such as a cellulose polymer, a polyacrylic acid polymer, a polyvinyl alcohol polymer and polyvinyl pyrrolidone, and an organic solvent-soluble polymer such as acryl resin, methacryl resin, polystyrene, polycarbonate, polysulfone, polyethersulfone, polyvinyl butyral, polyvinyl acetal, ethyl cellulose and nitro cellulose are employable. Among them, polyvinyl butyral, polyvinyl acetal and the cellulose resin are preferable, which are superior in the durability.

The contents of the colorant and the binder in the ink layer are not specifically limited; which are suitably decided from the viewpoint of the properties of the ink layer.

Various known additives can be added to the ink layer of the invention according to necessity additionally to the foregoing colorant and the binder. The ink layer can be formed, for example, by coating and drying an ink coating liquid by a known method such as a gravure coating method where the coating liquid is prepared by dissolving or dispersing the colorant, the binder and the additives in an optional solvent. The thickness of the ink layer of the invention is approximately from 0.1 to 3.0 μm, and preferably approximately from 0.3 to 1.5 μm.

(Protective Layer)

The thermal transfer ink sheet of the invention preferably has a thermally transferable protective layer. The thermally transferable protective layer is a transparent resin layer for forming a protective layer covering the surface of the image formed by thermal transfer onto the image receiving sheet.

The resin for forming the protective layer is, for example, a polyester resin, a polystyrene resin, an aryl resin, a polyurethane resin, an acrylurethane resin, a polycarbonate resin, an epoxy-modified resin of each the above resins, a mixture of each of the above resins, an, ionizing radiation curable resin and a UV cutting resin. The polyester resin, polycarbonate resin, epoxy-modified resin and ionizing radiation curable resin are preferable. As the polyester resin, an alicyclic polyester resin derived from one or more kinds of diol component and acid component having an alicyclic compound. As the polycarbonate resin, an aromatic polycarbonate rein is preferable, and aromatic polycarbonates described in JP-A No. 11-151867 are specifically preferred.

Examples of the epoxy-modified resin to be employed in the invention include an epoxy-modified urethane, an epoxy-modified polyethylene, an epoxy-modified polyethylene terephthalate, an epoxy-modified polyphenyl sulfite, an epoxy-modified cellulose, an epoxy-modified polypropylene, an epoxy-modified polyvinyl chloride, an epoxy-modified polycarbonate, an epoxy-modified acryl, an epoxy-modified polystyrene, an epoxy-modified polymethyl methacrylate, an epoxy-modified silicone, a copolymer of an epoxy-modified polystyrene and an epoxy-modified polymethyl methacrylate, a copolymer of an epoxy-modified acryl and an epoxy-modified polystyrene and a copolymer of an epoxy-modified acryl and an epoxy-modified silicone. The epoxy-modified acryl, the epoxy-modified polystyrene, the epoxy-modified polymethyl methacrylate and the epoxy-modified silicone are preferable and the copolymer of the epoxy-modified polystyrene and the epoxy-modified polymethyl methacrylate, the copolymer of the epoxy-modified acryl and the epoxy-modified polystyrene, and the copolymer of the epoxy-modified acryl and the epoxy-modified silicone are more preferable.

<Ionizing Radiation Curable Resin>

An ionizing radiation curable resin can be employed for the thermally transferable protective layer. An image excellent in the plasticizer resistivity and the anti-abrasion property can be obtained by using an ionizing radiation curable resin in the thermally transferable protective layer. Known ionizing radiation curable resins can be employed. For example, applicable is a polymerized and crosslinked radical polymerizable polymer or oligomer, in which an photo polymerization initiator is added when necessary, by applying ionizing radiation such as electron beam or UV rays.

<UV Cutting Resin>

The principal purpose of the protective layer containing a UV cutting resin is to provide a light resistivity to the printed material. For the UV cutting resin, for example, a resin obtained by reacting and bonding a reactive UV absorbent with the thermoplastic resin or the above ionizing radiation curable resin can be employed. In concrete, usable is a UV cutting resin obtained by introducing a reactive group having a addition polymerizable double bond (such as a vinyl group, an acryloyl group, a methacryloyl group, an alcoholic hydroxyl group, an amino group, a carboxyl group, an epoxy group or an isocyanate group) into a known non-reactive organic UV absorbent (UV absorbent containing, for example salicylate, benzophenone, benzotriazole, substituted acrylonitrile, a nickel chelate or a hindered amine).

The single structured thermal transferable protective layer described as above or a principal protective layer provided in a multi-layer structured thermal transferable protective layer is prepared so that the thickness is about 0.5 to 10 μm.

The thermal transferable protective layer of the invention is preferably provided on the substrate material through a non-transferable releasing layer.

The non-transferable releasing layer preferably contains (1) inorganic microparticles having an average particle diameter of not more than 40 nm in an amount of from 30 to 80% by weight together with a resin binder, (2) an alkyl vinyl ether.maleic anhydride copolymer, a derivative thereof or a mixture thereof in a rate of not less than 20% by weight, or (3) an ionomer in an ratio of not less than 20% by weight. The non-transferable releasing layer may contain another additive according to necessity.

For the inorganic microparticles, for example, a silica microparticles such as silica anhydride and colloidal silica, and a metal oxide such as tin oxide, zinc oxide and zinc antimonate can be employed. The particle diameter of the inorganic microparticle is preferably not more than 40 nm. When the diameter exceeds 40 nm, the irregularity of the surface of the thermal transferable protective layer is increased according to the irregularity of the releasing layer surface and undesirable lowering in the transparency of the protective layer is resulted.

For the resin binder to be mixed with the inorganic microparticles, any resin capable of mixing with the particle can be employed without any limitation. For example, polyvinyl alcohol resins (PVA) having various saponification degree, a polyvinyl acetal resin, a polyvinyl butyral resin, an acryl resin, a polyamide resin, a cellulose resin such as a cellulose acetate, an alkyl cellulose, a carboxymethyl cellulose, a hydroxyalkyl cellulose are employable.

The ratio of the inorganic microparticles to the other components mainly containing the resin binder (inorganic microparticles/other ingredients) is preferably from 30/70 to 80/20. When the ratio is less than 30/70, the effect of the microparticles become insufficient, and when the ratio exceeds 80/20, the releasing layer is not completely formed and a part where the substrate sheet and the protective layer are directly contacted is formed.

As the alkyl vinyl ether.maleic anhydride copolymer or the derivative thereof, one in which the alkyl group of the alkyl vinyl ether moiety is a methyl group or an ethyl group, or one in which the moiety of the maleic anhydride is completely or partially made of a half ester with an alcohol such as methanol, ethanol, propanol, isopropanol, butanol and isobutanol, is employable.

Though the releasing layer may be formed only by the alkyl vinyl ether.maleic anhydride, the derivative thereof or the mixture thereof, another resin or microparticles may be further added for controlling the peeling force between the releasing layer and the protective layer. In such the case, the alkyl vinyl ether.maleic anhydride, the derivative thereof or the mixture thereof is preferably contained in the releasing layer in an amount of not less than 20% by weight. The effects of the alkyl vinyl ether.maleic anhydride or the derivative thereof becomes insufficient when the content is less than 20% by weight.

The resin or the microparticles to be added to the alkyl vinyl ether.maleic anhydride or the derivative thereof is not specifically limited as long as they can be mixed with the alkyl vinyl ether.maleic anhydride or the derivative thereof and give high transparency on the occasion of the layer formation. For example, foregoing inorganic particles and the resin binders capable of mixing with the inorganic particles can be preferably employed.

As the ionomer, Surlyn A, manufactured by du Pont Co., Ltd., and Chemipearl series, manufactured by Mitsui Chemicals, Inc., are employable. To the ionomer, for example, the foregoing inorganic particle, a resin binder capable of mixing with the inorganic particle, or another resin or microparticles can be added.

For forming the releasing layer, a coating liquid containing the compositions of one of the foregoing (1) to (3) in the designated ratio is prepared and coated on the substrate sheet by a known method such as a gravure coating method and a gravure reverse coating method and dried. The thickness of the non-transferable releasing layer is usually about 0.1 to 2 μm after dried.

The thermally transferable protective layer laminated on the substrate sheet through or not through the non-transferable releasing layer may have a plural layer structure or a single layer structure. When the layer is constituted of plural layers, an adhesion layer arranged on the outermost surface of the thermally transferable protective layer for increasing the adhesiveness of the thermally transferable protective layer to the image receiving layer surface of the printed material, an assistance protective layer and a layer for adding a function other than the essential function of the protective layer such as a forgery prevention layer and a hologram layer may be provided additionally to the principal protective layer for giving various durability to the image. Though the order of the principal protective layer and the other layers may be optionally decided, usually the other layers are arranged between the adhesion layer and the principal protective layer so that the principal protective layer is to be the outermost surface of the image receiving surface after the transfer.

An adhesion layer may be provided on the outermost surface of the thermally transferable protective layer. The adhesion layer can be formed by a resin having high heat adhering property such as an acryl resin, a vinyl chloride resin, a vinyl acetate resin, a vinyl chloride/vinyl acetate resin, a polyester resin and a polyamide resin. The above resin may be mixed with another material such as the foregoing ionizing radiation curable resin and UV cutting resin if necessity. The thickness of the adhesion layer is usually from 0.1 to 5 μm.

For providing the thermally transferable protective layer on the non-transferable releasing layer or the substrate sheet, for example, a protective layer coating liquid containing the protective layer forming resin, a adhesion layer coating liquid containing the heat adhesion resin and a coating liquid for forming the additional layer according to necessity are previously prepared and these liquids are coated and dried on the non-transferable releasing layer or the substrate sheet in the designated order. The coating can be carried out by a known method. A suitable primer layer may be provided between each layer.

<UV Absorbent>

At least one of the layer in the thermally transferable protective layer preferably contains a UV absorbent. The UV absorbent is specifically preferably contained in the heat adhesion layer since the effects of the UV absorbent are lowered during a prolonged period when the UV absorbent is added into the transparent resin layer because the transparent resin layer is placed on the outermost surface after the transfer of the protective layer.

A UV absorbent containing salicylic acid, benzophenone, benzotriazole or cyanocarylate can be employed. Concrete examples of the UV absorbent employable in the invention include Tinuvin 234, Tinuvin 320, Tinuvin 326, Tinuvin 327, Tinuvin 328, Tinuvin 312 and Tinuvin 315, each manufactured by Ciba-Geigy Co., Ltd., Sumisorb-110, Sumisorb-130, Sumisorb-140, Sumisorb-200, Sumisorb-300, Sumisorb-320, Sumisorb-340, Sumisorb-350 and Sumisorb-400, each manufactured by Sumitomo Kagaku Kogyo Co., Ltd., and Mark LA-32, Mark LA-36 and Mark 1413, each manufactured by Adeca-Argus Co., Ltd., which are available on the market.

A random copolymer having a Tg of not less than 60° C., and preferably not less than 80° C., formed by random copolymerization of a reactive UV absorbent and an acryl monomer can be also employed.

As the above reactive UV absorbent, ones can be employed which are formed by introducing a group having additional polymerizable double bond such as a vinyl group, an acryloyl group and a methacryloyl group, an alcoholic hydroxide group, an amino group, a carboxyl group, an epoxy group or an isocyanate group to a known non-reactive UV absorbent containing, for example salicylate, benzophenone, benzotriazole, substituted acrylonitrile, a nickel chelate and a hindered amine. In concrete, they are available on the market under the commercial name of UV635 and UVA633L, each manufactured by BASF Japan Ltd., and PUVA-30M, manufactured by Ootsuks Chemical Co., Ltd., and employable in the invention.

The amount of the reactive UV absorbent in the random copolymer of the reactive UV absorbent and the acryl monomer is from 10 to 90% by weight, and preferably from 30 to 70% by weight. The molecular weight of the random copolymer is approximately from 5,000 to 250,000, and preferably approximately from 9,000 to 30,000. The UV absorbent and the random copolymer of the reactive UV absorbent and the acryl type monomer may be contained alone or in combination thereof. The adding amount of the random copolymer of the reactive UV absorbent and the acryl type monomer is preferably from 5 to 50% by weight based on weight of the layer containing those.

Of course, a light fastness improving agent other than the UV absorbent may be contained. The light fastness improving agent is an agent for preventing the modification and the decomposition of the colorant by blocking the action of light energy, heat energy and oxidation. In concrete, a light stabilizer known as the additive for synthesized resin is employable other than the above-mentioned UV cutting agent. In such the case, the UV absorbent is contained in at least one layer in the thermal transferable protective layer, namely in at lest one of the releasing layer, transparent resin layer and the thermal adhesion layer, and is specifically preferably contained in the thermal adhesion layer.

Though the using amount of the light fastness improving agent including the UV absorbent is not specifically limited, it is preferably from 0.05 to 10 parts by weight, and more preferably from 3 to 10 parts by weight in 100 parts by weight of the resin constituting the layer in which the light fastness improving agent is contained. The effects of the light fastness improving agent are hardly obtained when the using amount is too small, and the use of excessive amount is uneconomical.

Other than the light fastness improving agent, various kinds of additive such as a fluorescent whitening agent and a filler may be added to the adhesion layer in a suitable amount.

The transparent resin layer of the protective layer transfer sheet may be provided singly or in series with the surface of the thermal transfer ink sheet.

(Thermal Resistive Sliding Layer)

In the thermal transfer ink sheet of the invention, it is preferable to provide a thermal resistive sliding layer on the surface of the substrate sheet reverse to the ink layer side surface.

The thermal resistive sliding layer is provided for preventing the thermal fusion of the substrate sheet with the heating device such as a thermal head so as to smoothly slide the sheet and for removing the adhered matter on the thermal head.

For the thermal resistive sliding layer, a natural or a synthesized resin, for example, a cellulose resin such as ethyl cellulose, hydroxyl cellulose, methyl cellulose, cellulose acetate, cellulose acetate butylate and cellulose nitrate; a vinyl resin such as polyvinyl alcohol, polyvinyl acetate, polyvinyl butyral, polyvinyl acetal and polyvinyl pyrrolidone; an acryl resin such as polymethyl methacrylate, polyethyl methacrylate, polyacrylamide and acrylonitrile-styrene copolymer; polyimide resin, polyamide resin, polyamideimide resin, polyvinyltoluene resin, chromanindene resin, a polyester resin, polyurethane resin, silicone-modified or fluorine-modified urethane resin; are employed alone or in a form of mixture. For further raising the heat resistivity of the thermal resistive sliding layer, it is preferable to use a crosslinked resin layer formed by using a hydroxyl group-containing resin having a reactive group, together with a cross linking agent such as polyisocyanate.

A liquid or solid form release agent or a lubricant may be added to the thermal resistive sliding layer for giving a lubricative property against the thermal head. As the release agent or the lubricant, various kind of wax such as polyethylene wax and paraffin wax, a higher aliphatic alcohol, an organopolycyloxane, an anionic surfactant, a cationic surfactant, an amphoteric surfactant, a nonionic surfactant, a fluorinated surfactant, a metal soap, an organic carboxylic acid and its derivative, a fluororesin, a silicone resin, and inorganic microparticles such as talc and silica are employable. The amount of the lubricant contained in the heat resistive lubricant layer is from 5 to 50%, and preferably about from 10 to 30%, by weight. The thickness of the heat resistive lubricative layer is about from 0.1 to 10 μm, and preferably about from 0.3 to 5 μm.

EXAMPLES

The invention will be specifically described below referring examples, but the invention is not limited thereto.

Example 1

<<Preparation of Thermal Transfer Image Receiving Sheet>>

[Preparation of Thermal Transfer Image Receiving Sheet 1]

On a surface of a substrate sheet of synthesized paper having a thickness of 150 μm, YUPO FPG-150 manufactured by YUPO Corp., the following second intermediate layer coating liquid was coated using a wire bar coating method, followed by drying at 120° C. for 1 minute, to form a second intermediate layer having the dry solid content of 2.0 g/m$^2$.

Then, an image receiving layer coating liquid having the following composition was coated on the second intermediate layer using a wire bar coating method so as to have a dry solid content of 4 g/m$^2$ and then dried at 110° C. for 30 seconds to obtain Thermal Transfer Image Receiving Sheet 1.

| (Second Intermediate Layer Coating Liquid) | |
|---|---|
| 35% aqueous emulsion of acryl resin NIKASOL A-08 (NIPPON CARBIDE INDUSTRIES Co., Inc.) | 5.7 parts by weight |
| Purified water | 94.0 parts by weight |

The viscosity of the second intermediate layer coating liquid was 35 mPa·s.

| (Preparation of Image Receiving Layer Coating Liquid) | |
|---|---|
| B1: Vinyl chloride-vinyl acetate copolymer (vinyl chloride/vinyl acetate = 95/5) | 10.0 parts by weight |
| Releasing agent 1: Epoxy-modified silicone X-22-8300T (Shin-Etsu Chemical Co., Ltd.) | 1.0 part by weight |
| Methylethyl ketone/toluene = 1/1 | 40.0 parts by weight |

[Preparation of Thermal Transfer Image Receiving Sheet 2]

Thermal Transfer Image Receiving Sheet 2 was prepared in the same manner as in Thermal Transfer Image Receiving Sheet 1 except that the substrate sheet was changed to polyethylene coated paper constituted by raw paper with a weight of 170 g/m$^2$ covered with polyethylene on the both surfaces. In the polyethylene coated substrate sheet, the polyethylene layer of the porous layer side surface contained anatase type titanium oxide in an amount of 8%, and a 0.05 g/m$^2$ of gelatin subbing layer was provided on the porous layer side surface and a 0.2 g/m$^2$ of backing layer containing latex polymer having a Tg of about 80° C. was provided on the surface opposite to the porous layer side surface. Hereinafter, the substrate sheet having the above constitution was referred to as RC paper.

[Preparation of Thermal Transfer Image Receiving Sheet 3]

A porous intermediate layer coating liquid having the following constitution was coated using a wire bar on a surface of a polyethylene coated paper having, on a raw paper sheet of a weight of 170 g/m$^2$: (i) polyethylene layers on the both surfaces, in which the polyethylene layer of the porous layer side surface contained anatase type titanium oxide of the amount of 8% by weight; (ii) a 0.05 g/m$^2$ of gelatin subbing layer on the porous layer side surface; and (iii) a 0.2 g/m$^2$ of backing layer containing latex polymer having a Tg of about 80° C. on the surface opposite to the porous layer. Thus coated substrate was dried at 120° C. for 1 minute and a porous intermediate layer having a dry solid content of 16 g/m$^2$ was obtained. Then, the following second intermediate layer coating liquid was coated using a wire bar to form a second intermediate layer having a dry solid content of 2.0 g/m$^2$. Further, the following image receiving layer coating liquid was coated using a wire bar and dried at 120° C. for 1 minute to form an image receiving layer having a dry solid content of 4.0 g/m$^2$. Thus Thermal Transfer Image Receiving Sheet 3 was prepared. The void ratio of the porous intermediate layer was 60%.

| (Preparation of Porous Intermediate Layer Coating Liquid) | |
|---|---|
| B2: 5% aqueous solution of polyvinyl alcohol PVA 235 (KURARAY Co., Ltd.) | 30 parts by weight |
| Inorganic microparticles 1: Gas phase method silica Aerosil 200, diameter of primary particle: 12 nm (Nihon Aerosil Co., Ltd.,) | 20 parts by weight |
| Purified water | 20 parts by weight |
| (Preparation of Second Intermediate Layer Coating Liquid) | |
| 35% aqueous emulsion of acryl type resin NIKASOL A-08 (NIPPON CARBIDE INDUSTRIES Co., Inc.) | 5.7 parts by weight |
| Anatase type titanium oxide | 1.0 part by weight |
| Purified water | 93.0 parts by weight |

The viscosity of the second intermediate layer coating liquid was 38 mP·s.

| (Preparation of Image Receiving Layer Coating Liquid) | |
|---|---|
| B3: Emulsion resin (45% aqueous composition) (solid portion: 10 parts by weight) | 22 parts by weight |
| Release agent 3: silicone emulsion | 1 part by weight |
| Purified water | 77 parts by weight |

[Preparation of Thermal Transfer Image Receiving Sheets 4 through 16]

Thermal Transfer Image-Receiving Sheets 4 through 16 were prepared in the same manner as Thermal Transfer Image Receiving Sheet 3 except that the kind of substrate sheet, the constitution of the porous intermediate layer (the kind of inorganic microparticles, the kind of binder and the void ratio), the constitution of the image receiving layer (the binder and its solvent, the release agent, the surfactant and the hardening agent) and the thermal conductivity were changed as described in Table 1. The void ratio in the porous intermediate layer was controlled by suitably varying the ratio of the inorganic microparticles to the binder. The adding amounts of the surfactant, hardening agent and metal source were 1.0, 1.0 and 3.0 parts by weight, respectively.

[Preparation of Thermal Transfer Image Receiving Sheet 17]

The thermal transfer image receiving sheet described in Example 1 of JP-A 11-301124 was prepared and designated as Thermal Transfer Image Receiving Sheet 17.

[Preparation of Thermal Transfer Image Receiving Sheet 18]

The thermal transfer image receiving member described in Example 1 of JP-A 2000-238440 was prepared and designated as Thermal Transfer Image Receiving Sheet 18.

TABLE 1

| Thermal transfer image receiving sheet | substrate | Porous intermediate layer: Inorganic micro-particle No. | Kind | Particle diameter (nm) | Binder No. | Void ratio (%) | Forming method | *2 | Image receiving layer: Binder No. | Releasing agent No. | Surfactant No. | Hardening Agent No. | MS | Heat conductance (W/mK) | Remarks |
|---|---|---|---|---|---|---|---|---|---|---|---|---|---|---|---|
| 1 | Synthesized paper | — | — | — | — | — | — | Yes | B1 | 1 | — | — | — | 0.24 | Comp. |
| 2 | RC paper | — | — | — | — | — | — | Yes | B1 | 1 | — | — | — | 0.24 | Comp. |
| 3 | RC paper | 1 | 1 | 12 | B2 | 60 | Coating | Yes | B3 | 3 | — | — | — | 0.24 | Inv. |
| 4 | RC paper | 2 | 2 | 7 | B2 | 57 | Coating | Yes | B3 | 3 | — | 1 | — | 0.22 | Inv. |
| 5 | RC paper | 3 | 3 | 20 | B2 | 38 | Coating | Yes | B3 | 3 | S1 | 1 | — | 0.23 | Inv. |
| 6 | RC paper | 4 | 1 | 12 | B2 | 62 | Coating | Yes | B4 | 2 | S2 | 2 | — | 0.25 | Inv. |
| 7 | RC paper | 5 | 2 | 7 | B2 | 65 | Coating | Yes | B4 | 2 | — | 2 | — | 0.25 | Inv. |
| 8 | RC paper | 6 | 4 | 20 | B2 | 60 | Coating | Yes | B4 | 2 | — | 2 | — | 0.24 | Inv. |
| 9 | RC paper | 7 | 5 | 20 | B2 | 60 | Coating | Yes | B5 | 2 | S1 | 2 | MS-1 | 0.24 | Inv. |
| 10 | RC paper | 8 | 6 | 20 | B7 | 60 | Coating | Yes | B4 | 2 | S1 | 2 | MS-1 | 0.24 | Inv. |
| 11 | RC paper | 9 | 6 | 20 | B2 | 60 | Coating | Yes | B4 | 2 | S1 | 2 | MS-1 | 0.24 | Inv. |
| 12 | RC paper | 10 | 1 | 12 | B2 | 63 | Coating | Yes | B5 | 2 | S1 | 2 | MS-1 | 0.25 | Inv. |
| 13 | PET | 11 | 2 | 7 | B2 | 62 | Coating | Yes | B6 | 2 | S2 | 2 | MS-1 | 0.25 | Inv. |
| 14 | PET | 12 | 3 | 20 | B7 | 56 | Coating | Yes | B3 | 3 | S2 | 1 | MS-2 | 0.22 | Inv. |
| 15 | PET | 13 | 1 | 12 | B7 | 63 | Coating | Yes | B1 | 2 | — | — | MS-1 | 0.25 | Inv. |
| 16 | RC paper | 14 | 1 | 12 | B7 | 25 | Coating | Yes | B1 | 2 | — | — | MS-1 | 0.41 | Comp. |
| 17 | The thermal transfer image receiving sheet described in Example 1 in JP-A 11-301124 | | | | | | | | | | | | | | Comp. |
| 18 | The thermal transfer image receiving member described in Example 1 in JP-A 2000-238440 | | | | | | | | | | | | | | Comp. |

*2: Presence of second intermediate layer
Comp.: Comparative
Inv.: Inventive
*MS: Metal source The details of the additives shown in Table 1 with abbreviations are listed blow.

(Substrate Sheet 3: Polyethylene Terephthalate Film)

A polyethylene terephthalate film (referred to as PET) of a thickness of 100 μm having a subbing layer described in Example 1 of JP-A 2003-72229 was used.

(Inorganic Microparticles)

Inorganic microparticles 1: Gas phase method silica having a diameter of a primary particle of 12 nm Inorganic microparticles 2: Gas phase method silica having a diameter of a primary particle of 7 nm Inorganic microparticles 3: Gas phase method silica having a diameter of a primary particle of 20 nm Inorganic microparticles 4: Synthesized amorphous silica having a diameter of a primary particle of 20 nm Inorganic microparticles 5: Gas phase method alumina having a diameter of a primary particle of 20 nm Inorganic microparticles 6: Titania having a diameter of a primary particle of 20 nm (Binder and Solvent)

B1: vinyl chloride-vinyl acetate copolymer—methyletyl ketone/tluene=1/1 (by weight)

B2: Polyvinyl alcohol—purified water

B3: emulsion resin(*1)—purified water

B4: Cellulose acetate—methyletyl ketone/tluene=1/1 (by weight)

B5: Polyethylene terephthalate—phenol/dichloroethane=1/1 (by weight)

B6: Polycarbonate—dichloromethane

B7: Cation-modified polyvinyl alcohol—purified water*1: 400 g of 1.5% polyvinyl alcohol (PVA with a polymerization degree of 1700 and a saponification degree of 88.5 mole %) aqueous solution was adjusted at a pH of 3.5 and 50 g of methyl methacrylate and 50 g of butyl acrylate were added while stirring, and the temperature of the mixture was raised to 60° C. Subsequently, 10 g of 5% ammonium persulfate aqueous solution was added to start polymerization. After 15 minutes, 100 g of methyl methacrylate and 100 g of butyl acrylate were gradually added spending 3 hours. After 5 hours, the reaction liquid was cooled when the polymerization degree was attained at 99.9% and neutralized to a pH of 7. Thus Emulsion resin B7 was synthesized.

(Release agent)

Release agent 1: Epoxy-modified silicone

Release agent 2: Dimethyl silicone

Release agent 3: Emulsion type silicone KM 786 (Shin-Etsu Chemical Co., Ltd.)

(Surfactant)

S1: Silicone type surfactant Emalex SS-5602 (Nihon Emulsion Co., Ltd.)

S2: Fluorinated surfactant FC-4430 (Sumitomo 3M Co., Ltd.)

(Hardening Agent)

1: Boric acid/borax=1/1 (by weight)

2: Self-linking isocianate (MS: metal source)

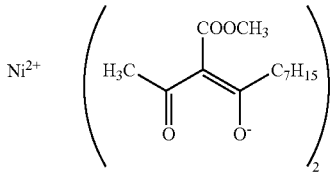

MS-1:

MS-2: $NiCl_2$

The thermal conductivity described in Table 1 was measured by the rapid thermal conductivity meter QTM-500, manufactured by Kyoto Denshi Kogyo Co., Ltd., with the automatic calculation soft wear for thin layer measurement SOFT-QTM5W.

<<Image Formation>>

Each of the above prepared thermal transfer image receiving sheets was placed on the following thermal transfer ink sheet and set into a thermal transfer recording apparatus having a thermal line head with a square-shaped resistor (length in the main scanning direction of 80 μm×length in the sub-scanning direction of 120 μm) and 300 dpi (dpi: number of dot per 2.54 cm), and conveyed while contacting by pressing with the thermal head and a platen roller. Step pattern patches of yellow, magenta, cyan and neutral (by overlapping yellow, magenta and cyan) were formed by transferring the colorants onto the image receiving layer of the thermal transfer image receiving sheet by heating from the back side of the ink layer while successively increasing the applying energy at a conveying rate of 2.5 msec/line and a conveying length per line of 85 μm. Thus Images 1 through 18 were prepared.

Thermal transfer sheet A: A thermal transfer ink sheet for Camedia P-400, manufactured by Olympus Co., Ltd., which was employed in combination with Thermal Transfer Image Receiving Sheets 1 to 8, 17 or 18.

Thermal transfer sheet B: A thermal transfer ink sheet for Pe 602, manufactured by Konica Minolta Photo Imaging Inc., which was employed in combination with Thermal Transfer Image Receiving Sheets 9 to 16.

<<Evaluation of Formed Image>>

The above printed images were subjected to the following evaluation methods.

(Evaluation of Curling Property)

The above prepared thermal transfer image receiving sheet was cut into a square of 20 cm×20 cm, and placed on a flat plate so that the image receiving layer is to be up side and stood for 5 hours under a condition of 23° C. and 50% RH. And then the height of each of the four corners from the flat plate was measured and the largest value was defined as the measure of curling property.

(Evaluation on Anti-Sticking Property)

The degree of the occurrence of the sticking of the thermal transfer image receiving sheet to the thermal transfer ink sheet was visually observed on the occasion of the image printing, and the anti-sticking property was evaluated according to the following categories.

A: No sticking between the thermal transfer image receiving sheet and the thermal transfer ink sheet was observed.

B: Almost no sticking between the thermal transfer image receiving sheet and the thermal transfer ink sheet was observed.

C: Occurrence of limited sticking at the surface of the thermal transfer image receiving sheet was observed while the thermal transfer ink sheet was transferred but any wrinkle was not formed on the thermal transfer ink sheet.

D: Occurrence of sticking at the surface of the thermal transfer image receiving sheet was clearly observed while the thermal transfer ink sheet was transferred and wrinkles were strongly formed on the thermal transfer ink sheet.

(Evaluation of Printing Sensitivity)

In the above-mentioned image forming method, the image formation was performed employing each of the thermal transfer image receiving sheet while varying the applying energy and the applying energy E ($mJ/mm^2$) necessary for forming a reflective density of 1.0 was measured and the printing sensitivity was evaluated according to the following criteria.

A: $E \leqq 4.8\ mJ/mm^2$

B: $4.8\ mJ/mm^2 < E \leqq 5.2\ mJ/mm^2$

C: $5.2\ mJ/mm^2 < E \leqq 5.6\ mJ/mm^2$

D: $E > 5.6\ mJ/mm^2$ (Evaluation on Anti-White Spots in the Image)

Occurrence of the white spots in the image (white spots in a solid image) in the step pattern patch image was visually observed and the anti-white spots property was evaluated according to the following criteria.

A: No occurrence of the white spots in the image was observed.

B: Almost no occurrence of the white spots in the image was observed.

C: Occurrence of minute white spots was sporadically observed in the image but acceptable for practical use.

D: Occurrence of white spots was strongly observed in the image and the image quality was not acceptable for practical use.

The above obtained results are listed in Table 2.

TABLE 2

| | | | Evaluation results | | | | |
|---|---|---|---|---|---|---|---|
| Image No. | Thermal transfer image receiving sheet | Thermal transfer ink sheet | Curling property (mm) | Anti-sticking property | Sensitivity | Anti-white spots property | Remarks |
| 1 | 1 | A | 7.9 | D | D | C | Comp. |
| 2 | 2 | A | 5.8 | D | D | C | Comp. |
| 3 | 3 | A | 3.1 | C | C | C | Inv. |
| 4 | 4 | A | 2.8 | B | B | B | Inv. |
| 5 | 5 | A | 2.9 | B | C | B | Inv. |
| 6 | 6 | A | 2.1 | B | B | B | Inv. |

TABLE 2-continued

| Image No. | Thermal transfer image receiving sheet | Thermal transfer ink sheet | Evaluation results: Curling property (mm) | Anti-sticking property | Sensitivity | Anti-white spots property | Remarks |
|---|---|---|---|---|---|---|---|
| 7 | 7 | A | 2.3 | B | B | A | Inv. |
| 8 | 8 | A | 2.1 | B | B | B | Inv. |
| 9 | 9 | B | 1.1 | A | A | A | Inv. |
| 10 | 9 | B | 1.0 | A | A | A | Inv. |
| 11 | 10 | B | 1.5 | A | B | A | Inv. |
| 12 | 11 | B | 1.6 | A | B | A | Inv. |
| 13 | 12 | B | 0.9 | B | B | B | Inv. |
| 14 | 13 | B | 0.6 | B | B | A | Inv. |
| 15 | 14 | B | 1.1 | C | B | B | Inv. |
| 16 | 15 | B | 5.1 | D | C | C | Comp. |
| 17 | 16 | A | 5.8 | D | C | D | Comp. |
| 18 | 17 | A | 5.9 | D | C | D | Comp. |

Comp.: Comparative
Inv.: Inventive

As is clear from the results listed in Table 2, it is understood that the thermal transfer image receiving sheets according to the constitution of the invention are superior to the comparative samples in the curling property, anti-sticking property, anti-white spots property, and the printing sensitivity.

Example 2

Thermal transfer image receiving sheets were prepared in the same manner as in Thermal Transfer Image Receiving Sheet 9 except that the viscosity of the second intermediate layer coating liquid to be coated on the porous intermediate layer was varied to 20, 25, 30, 35, 40, 45 and 55 mPa·s, respectively. The prepared sheets were subjected to image formation and evaluated according to the method described in Example 1. From the results, it was confirmed that the anti-white spots property is further improved in which the viscosity of the second intermediate layer coating liquid was 30 mPa·s or more compared with the samples in each of which the viscosity of the second intermediate layer coating liquid was 20 and 25 mPa·s.

Example 3

Thermal transfer image receiving sheets were prepared in the same manner as in Thermal Transfer Image Receiving Sheet 9 except that the ratio of solid components in the porous intermediate layer while coating was varied to 40, 60, 80, 85 and 90% by weight. The prepared sheets were subjected to image formation and evaluated according to the method described in Example 1. From the results, it was confirmed that the excellent curling property, sensitivity and ant-sticking property were attained by making the solid components ratio in the porous intermediate layer while coating not more than 80% by weight.

What is claimed is:

1. A thermal transfer image receiving sheet comprising a substrate having thereon a porous intermediate layer and an image receiving layer in that order, wherein the porous intermediate layer has a void ratio of not less than 30%;

the porous intermediate layer contains inorganic microparticles and a binder;

the porous intermediate layer and the image receiving layer are formed by a coating method; and the porous intermediate layer has a mass ratio of the inorganic particles to the binder from 5:1 to 20:1; and an average diameter of primary particles of the inorganic microparticles is 3 to 100 nm.

2. The thermal transfer image receiving sheet of claim 1, wherein the inorganic microparticles contained in the porous intermediate layer are selected from the group consisting of silica, alumina and titania.

3. The thermal transfer image receiving sheet of claim 1, wherein the binder in the porous intermediate layer is:

a hydrophilic binder; or an emulsion resin binder formed by emulsion polymerization using a polymer dispersant containing a hydroxyl group.

4. The thermal transfer image receiving sheet of claim 1, wherein a coating liquid for a layer applied on the porous intermediate layer has a viscosity of not less than 30 mPa·s.

5. The thermal transfer image receiving sheet of claim 1, wherein a solid content of the porous intermediate layer is not more than 80% by weight when another layer is applied on the porous intermediate layer.

6. The thermal transfer image receiving sheet of claim 1, wherein the image receiving layer contains a compound having a metal ion; and the compound having the metal ion forms a chelate compound by reacting with a colorant capable of forming a chelate.

7. The thermal transfer image receiving sheet of claim 6, wherein the compound having a metal ion is an inorganic salt.

8. The thermal transfer image receiving sheet of claim 1, wherein the substrate is a resin coated paper sheet having a thickness of 50 to 250 μm.

9. The thermal transfer image receiving sheet of claim 1, wherein a second intermediate layer is provided between the porous intermediate layer and the image receiving layer.

10. The thermal transfer image receiving sheet of claim 9, wherein the second intermediate layer contains microparticles.

11. The thermal transfer image receiving sheet of claim 1, wherein the image receiving layer contains a resin selected from the group consisting of a polycarbonate resin, a cellulose resin and a polyester resin.

12. The thermal transfer image receiving sheet of claim 1, wherein a coating solution for the image receiving layer has a pH of not more than 8.0.

13. The thermal transfer image receiving sheet of claim 1, wherein the intermediated layer or the image receiving layer contains a hardening agent.

14. The thermal transfer image receiving sheet of claim 1, wherein the image receiving layer contains a release agent.

15. The thermal transfer image receiving sheet of claim 14, wherein the release agent is a silicone emulsion release agent or a water-soluble release agent.

16. The thermal transfer image receiving sheet of claim 1, wherein the image receiving layer contains a silicone surfactant.

17. The thermal transfer image receiving sheet of claim 1, wherein the image receiving layer contains a fluorinated surfactant.

18. The thermal transfer image receiving sheet of claim 1, wherein a thermal conductivity of the thermal transfer image receiving sheet is not more than 0.35 W/mK.

19. The thermal transfer image receiving sheet of claim 18, wherein the thermal conductivity of the thermal transfer image receiving sheet is not more than 0.27 W/mK.

20. The thermal transfer image receiving sheet of claim 1, wherein the mass ratio of the inorganic microparticles to the binder is from 5:1 to 12:1.

21. The thermal transfer image receiving sheet of claim 1, wherein the primary particle diameter of the inorganic microparticles is 3 to 20 nm.

22. The thermal transfer image receiving sheet of claim 1, wherein the inorganic microparticles are silica microparticles prepared by a gas phase method having an average diameter of primary particles of 3 to 20 nm.

23. A method of producing a thermal transfer image receiving sheet comprising the steps of:

forming a porous intermediate layer containing inorganic microparticles and a binder on a substrate by a coating method; and forming an image receiving layer on the porous intermediate layer by a coating method, wherein the porous intermediate layer has a void ratio of not less than 30%;

the void ratio in the porous intermediate layer is controlled by varying the mass ratio of the inorganic microparticles to the binder in the range of from 5:1 to 20:1; and an average diameter of primary particles of the inorganic microparticles is 3 to 100 nm.

24. The method of claim 23, wherein the mass ratio of the inorganic microparticles to the binder is from 5:1 to 12:1.

25. The method of claim 23, wherein the primary particle diameter of the inorganic microparticles is 3 to 20 nm.

26. The method of claim 23, wherein the inorganic microparticles are silica microparticles prepared by a gas phase method having an average diameter of primary particles of 3 to 20 nm.

* * * * *